US010767952B1

(12) United States Patent
Till et al.

(10) Patent No.: US 10,767,952 B1
(45) Date of Patent: Sep. 8, 2020

(54) MODULAR MUZZLE DEVICE ADAPTER SYSTEM

(71) Applicant: Battlearms IP, LLC, Henderson, NV (US)

(72) Inventors: Brent Till, Goodyear, AZ (US); George Huang, Henderson, NV (US)

(73) Assignee: Battlearms IP, LLC, Henderson, NV (US)

( * ) Notice: Subject to any disclaimer, the term of this patent is extended or adjusted under 35 U.S.C. 154(b) by 0 days.

(21) Appl. No.: 16/656,560

(22) Filed: Oct. 17, 2019

Related U.S. Application Data

(60) Provisional application No. 62/747,435, filed on Oct. 18, 2018.

(51) Int. Cl.
*F41A 21/32* (2006.01)
*F41A 21/36* (2006.01)

(52) U.S. Cl.
CPC ..... *F41A 21/325* (2013.01); *F41A 21/36* (2013.01)

(58) Field of Classification Search
CPC ..... F41A 21/32; F41A 21/325; F41A 21/36; F41A 21/34
USPC ..... 42/1.06; 89/14.2, 14.3
See application file for complete search history.

(56) References Cited

U.S. PATENT DOCUMENTS

| | | | | |
|---|---|---|---|---|
| 3,978,762 | A * | 9/1976 | Khaidurov | F41A 21/36 89/14.3 |
| 4,691,614 | A * | 9/1987 | Leffel | F41A 21/36 89/14.3 |
| 4,811,648 | A * | 3/1989 | Blackwell | F41A 21/36 89/14.3 |
| 5,076,137 | A * | 12/1991 | Paredes | F41A 21/36 89/14.3 |
| 5,433,133 | A * | 7/1995 | La France | F41A 21/325 89/14.2 |
| 5,549,030 | A * | 8/1996 | Lespron | F41A 21/36 89/14.3 |
| 7,059,235 | B2 * | 6/2006 | Hanslick | F41A 21/38 89/14.3 |
| 7,748,306 | B1 * | 7/2010 | Curry | F41A 21/28 42/1.06 |
| 2016/0123690 | A1 * | 5/2016 | Larson, Jr. | F41A 3/66 89/14.3 |

* cited by examiner

*Primary Examiner* — Reginald S Tillman, Jr.
(74) *Attorney, Agent, or Firm* — Shaddock Law Group, PC

(57) ABSTRACT

A modular muzzle device adapter system having an adapter, wherein the adapter comprises an adapter body portion and an adapter projection portion, wherein the adapter includes an adapter barrel aperture formed so as to extend through the adapter; and a muzzle device, wherein the muzzle device comprises a muzzle device body portion and a muzzle device recess, wherein the muzzle device is repeatably securable to and removable from the adapter, via at least some interaction between the adapter projection portion of the adapter and the muzzle device recess of the muzzle device.

17 Claims, 24 Drawing Sheets

MODULAR MUZZLE DEVICE ADAPTER SYSTEM

CROSS-REFERENCE TO RELATED APPLICATIONS

This patent application claims the benefit of U.S. Patent Application Ser. No. 62/747,435, filed Oct. 18, 2018, the disclosures of which are incorporated herein by reference in their entireties.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to a modular muzzle device adapter system for a firearm.

2. Description of Related Art

The firing of a handgun is accompanied by a recoil action which manifests itself in the form of a sudden upward movement of the handgun, jerking the handgun away from the target, known as muzzle flip. This is extremely disadvantageous especially when it is desirous to repeatedly fire the handgun in rapid succession, the recoil action requiring that the handgun be rapidly returned to the desired position and steadied in order to be assured that the next projectile to be fired will strike the target at the desired location.

A compensator is a device that is attached to the terminal end of a muzzle of a firearm that redirects propellant gases to counter recoil and unwanted firearm barrel rise that normally occurs during the typical firing sequence. Compensators, muzzle brakes, or other muzzle devices are typically attached to a firearm barrel via interaction between internal threads of the muzzle device and external threads at the muzzle end of the firearm barrel.

During normal operation of a firearm, and particularly a rifle, when a round is fired, gas from the burning propellant forces the bullet through the firearm barrel. As the bullet travels down and out of the firearm barrel, the bullet and the propellant gases act on firearm barrel, along the longitudinal axis, or centerline, of the firearm barrel, to produce a recoil force. Because of the difference between the longitudinal axis of the firearm barrel and the average point of contact between the firearm and the user (the average point where the user resists the recoil force), the muzzle end of the firearm's firearm barrel rotates upward.

Compensators typically utilize one or more slots, vents, holes, and/or baffles to divert and/or redirect the propellant gases as they leave the firearm barrel. Generally, compensators divert and/or redirect the propellant gases horizontally (left and right), at some angle that is substantially perpendicular to the longitudinal axis of the firearm barrel.

Existing compensators for handguns are typically made of one-piece construction and do not allow for customization for individual users.

Any discussion of documents, acts, materials, devices, articles, or the like, which has been included in the present specification is not to be taken as an admission that any or all of these matters form part of the prior art base, were widely known, or were common general knowledge in the field relevant to the present disclosure as it existed before the priority date of each claim of this application.

BRIEF SUMMARY OF THE INVENTION

Unfortunately, there is no current design that allows for the fast and repeatable attachment of a muzzle device (i.e., compensators, flash hiders, suppressors, bayonets, lights, front sights, camera module, etc.) to a firearm barrel in a manner that ensures correct and repeatable timing of the device relative to the firearm barrel.

The modular muzzle device adapter system of the present disclosure overcomes the disadvantages of the conventional handgun with or without conventional compensator system and achieves the above-mentioned objectives through the employment of a modular muzzle device adapter system, which is characterized by comprising an adapter further comprising an attachment means for coupling the adapter to a handgun and a bore configured to allow a projectile to pass through; and a muzzle device configured to removably attach to the adapter. In various exemplary embodiments, the muzzle device further comprises at least one muzzle device port located on a top portion of the muzzle device.

In various exemplary, nonlimiting embodiments, the modular muzzle device adapter system of the present disclosure comprises at least some of an adapter and a muzzle device. In various exemplary, nonlimiting embodiments, the adapter further comprises an attachment means for coupling the adapter to a handgun and an adapter barrel aperture or bore configured to allow a projectile to pass through the adapter.

In various exemplary, nonlimiting embodiments, the adapter has a generally rectangular shape with a protrusion extending from a bottom surface of the adapter. In various exemplary embodiment, the protrusion houses a spring biased detent that optionally extends out of the adapter mating surface. The protrusion optionally further comprises a recess configured to hold a spring tensioning element and a detent. The detent is optionally held in place such that a small portion of the detent extends out of the adapter.

The adapter optionally further comprises an extension of the mating surface where the extension further comprises an angled edge. The angled edge of the mating surface extension optionally forms an acute angle. Alternatively, the angled edge of the adapter mating surface extension is a tabbed edge.

The muzzle device is optionally a tubular shape with a flat mating surface on a first end and an enclosed face on a second end. Both the flat mating surface and the enclosed face further comprise a through hole sized just larger than the adapter barrel aperture of a handgun. The flat mating surface optionally further comprises a lip around a plurality of edges where the lip extends outward from the mating surface.

The muzzle device mating surface optionally further comprises a hole in a bottom portion of the mating surface. The lip is optionally angled to match the angled edge of the adapter mating surface extension. Alternatively, the lip is comprised of a squared slotted edge. Thus, the muzzle device is optionally removably attached to the adapter by sliding the lip of the muzzle device over the extension of the adapter. While the muzzle device is being slid onto the adapter, the detent is pushed back into the adapter against the spring. Once the muzzle device is in place the detent is pushed outwardly by the spring such that the detent is inserted into the hole on the muzzle device mating surface.

The muzzle device optionally further comprises at least one muzzle device port located on a top portion of the compensation module. Alternatively, the compensation module optionally further comprises at least one muzzle device port on each side of the compensation module.

The attachment means for the adapter to removably couple to the firearm barrel optionally comprises a portion of the adapter barrel aperture to be threaded such that the threaded portion of the adapter barrel aperture matches a threaded firearm barrel. Alternatively, the attachment means is an elongated section configured to slide onto a standard picatinny rail on the underside of a handgun frame. This alternate embodiment could also include at least one fastener configured to extend through the elongated section and tighten against the picatinny rail to hold the adapter in place.

In various exemplary, nonlimiting embodiments, the modular muzzle device adapter system of the present disclosure comprises at least some of an adapter, wherein the adapter comprises an adapter body portion and an adapter projection portion, and wherein the adapter includes an adapter barrel aperture formed so as to extend through the adapter; and a muzzle device, and wherein the muzzle device comprises a muzzle device body portion and a muzzle device recess, wherein the muzzle device is repeatably securable to and removable from the adapter, via at least some interaction between the adapter projection portion of the adapter and the muzzle device recess of the muzzle device.

In various exemplary, nonlimiting embodiments, an adapter projection is formed as a portion of the adapter projection portion of the adapter, and wherein at least a portion of the muzzle device recess is mateable with the adapter projection.

In various exemplary, nonlimiting embodiments, the adapter projection is a dovetail projection and the muzzle device recess is a dovetail muzzle device recess, and wherein the muzzle device is attachable to the adapter via slidable interaction between at least a portion of the adapter projection and at least a portion of the muzzle device recess.

In various exemplary, nonlimiting embodiments, the adapter projection is a 3-sided dovetail projection and the muzzle device recess is a 3-sided dovetail muzzle device recess, and wherein the muzzle device is attachable to the adapter via slidable interaction between at least a portion of the adapter projection and at least a portion of the muzzle device recess.

In various exemplary, nonlimiting embodiments, the adapter projection comprises one or more projection locking extensions and the muzzle device recess comprises a muzzle device aperture opening having one or more keyhole slots, wherein each keyhole slot corresponds to one of the projection locking extensions, and wherein the muzzle device is attachable to the adapter via at least partial rotatable interaction between at least a portion of the adapter projection and at least a portion of the muzzle device recess.

In various exemplary, nonlimiting embodiments, the adapter barrel aperture extends through the adapter, from a proximal end of the adapter to a distal end of the adapter, substantially parallel to a longitudinal axis, AL, of the adapter.

In various exemplary, nonlimiting embodiments, a barrel aperture threaded portion is formed in at least a portion of the adapter barrel aperture, wherein the barrel aperture threaded portion is formed so as to interact with a threaded portion of a firearm barrel such that the adapter may optionally be threadably secured to a firearm barrel, via interaction of the external muzzle threads of the firearm barrel and the internal threads of the barrel aperture threaded portion.

In various exemplary, nonlimiting embodiments, one or more fastening element apertures are formed through at least a portion of the adapter body portion, wherein each fastening element aperture is formed so as to allow a fastening element to extend through the adapter body portion and into the adapter barrel aperture, such that the adapter may optionally be secured to a firearm barrel, via frictional engagement between the firearm barrel and at least a portion of the one or more fasteners extending into the adapter barrel aperture.

In various exemplary, nonlimiting embodiments, the one or more fastening element apertures are formed proximate a non-threaded portion of the adapter barrel aperture.

In various exemplary, nonlimiting embodiments, the one or more fastening element apertures are formed through at least a portion of the adapter body portion, within the barrel aperture threaded portion.

In various exemplary, nonlimiting embodiments, a detent is slidably positioned within an adapter detent aperture of the adapter, wherein the adapter detent aperture is formed at a distance spaced apart from the adapter barrel aperture, wherein the detent is repeatably slidable between an engaged position and a disengaged position, wherein at least a portion of the detent extends from the adapter in the engaged position, and wherein the detent is retracted within the adapter is the disengaged position.

In various exemplary, nonlimiting embodiments, the detent is spring biased to the engaged position.

In various exemplary, nonlimiting embodiments, a muzzle device detent aperture is formed at a distance spaced apart from the muzzle device aperture, wherein the muzzle device detent aperture is formed so as to receive at least a portion of the detent at least partially therein when the muzzle device detent aperture is aligned with the adapter detent aperture and the detent is in the engaged position.

In various exemplary, nonlimiting embodiments, the muzzle device muzzle device includes a muzzle device aperture formed such that when the muzzle device is appropriately attached or coupled to the adapter, the muzzle device aperture is aligned with the adapter barrel aperture.

In various exemplary, nonlimiting embodiments, the muzzle device includes one or more muzzle device ports formed through a portion of the muzzle device body portion, extending from a portion of the muzzle device aperture to an outer surface of the muzzle device body portion.

In various exemplary, nonlimiting embodiments, the adapter or the muzzle device includes front sight.

In various exemplary, nonlimiting embodiments, the adapter or the muzzle device includes a dovetail or other sight recess formed in a portion thereof to allow a front sight to be installed on the adapter or the muzzle device.

In various exemplary, nonlimiting embodiments, the modular muzzle device adapter system of the present disclosure comprises at least some of an adapter, wherein the adapter comprises an adapter body portion and an adapter projection portion, wherein the adapter includes an adapter barrel aperture formed so as to extend through the adapter, wherein an adapter projection is formed as a portion of the adapter projection portion of the adapter, wherein at least a portion of the muzzle device recess is mateable with the adapter projection, and wherein one or more fastening element apertures are formed through at least a portion of the adapter body portion, wherein each fastening element aperture is formed so as to allow a fastening element to extend through the adapter body portion and into the adapter barrel aperture, such that the adapter may optionally be secured to a firearm barrel, via frictional engagement between the firearm barrel and at least a portion of the one or more fasteners extending into the adapter barrel aperture; and a muzzle device, wherein the muzzle device comprises a muzzle device body portion and a muzzle device recess, wherein the muzzle device is repeatably securable to and removable from the adapter, via at least some interaction between the adapter projection portion of the adapter and the muzzle device recess of the muzzle device, and wherein the muzzle device muzzle device includes a muzzle device aperture formed such that when the muzzle device is appropriately attached or coupled to the adapter, the muzzle device aperture is aligned with the adapter barrel aperture.

Although the modular muzzle device adapter system of the present disclosure has been described by way of example, it should be appreciated that variations and modifications may be made without departing from the scope of the present disclosure. Furthermore, where known equivalents exist to specific features, such equivalents are incorporated as if specifically referred to in this specification.

In various exemplary embodiments of the present disclosure, there is provided a modular muzzle device adapter system wherein the adapter is removably attached to the muzzle device such that the mating surfaces fit flush.

In various exemplary embodiments of the present disclosure, there is provided a modular muzzle device adapter system where the adapter further comprises an attachment means for removably coupling the adapter to a firearm.

Accordingly, the presently disclosed systems, methods, and/or apparatuses provide a modular muzzle device adapter system that allows for the removable attachment or coupling of a muzzle device to an adapter.

The presently disclosed systems, methods, and/or apparatuses separately provide a modular muzzle device adapter system that can be quickly and easily retrofitted to an existing firearm barrel.

The presently disclosed systems, methods, and/or apparatuses separately provide a modular muzzle device adapter system that can be quickly and easily manipulated by a user.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

Figure 1:
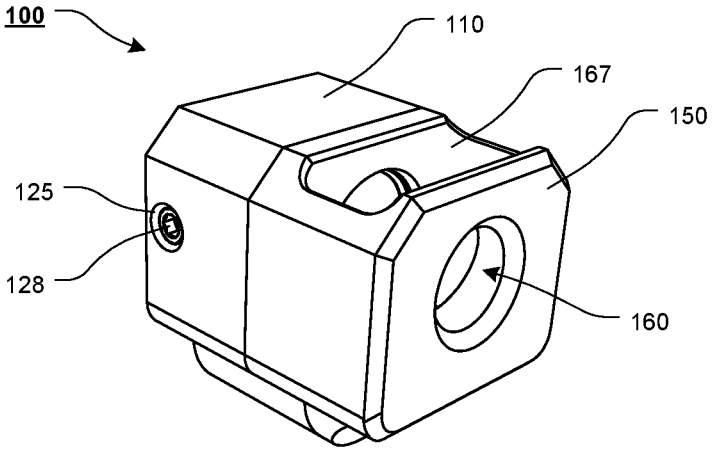
FIG. 1 illustrates an upper, front perspective view of an exemplary embodiment of a modular muzzle device adapter system, according to the present disclosure.
Figure 2:
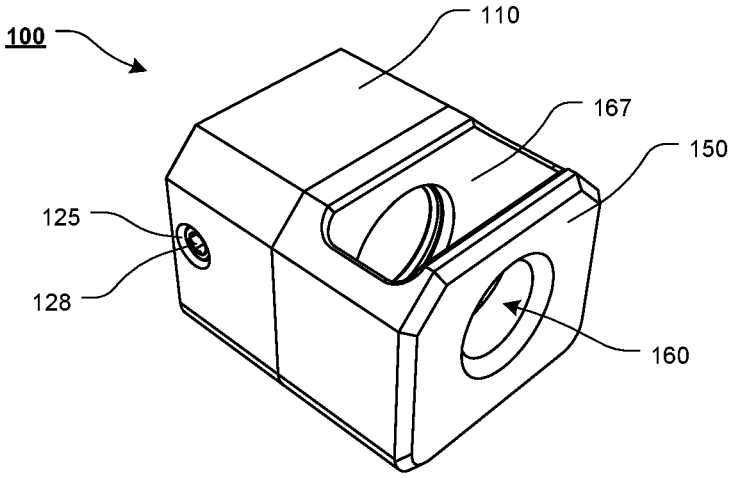
FIG. 2 illustrates an upper, front perspective view of an exemplary embodiment of a modular muzzle device adapter system, according to the present disclosure.
Figure 3:
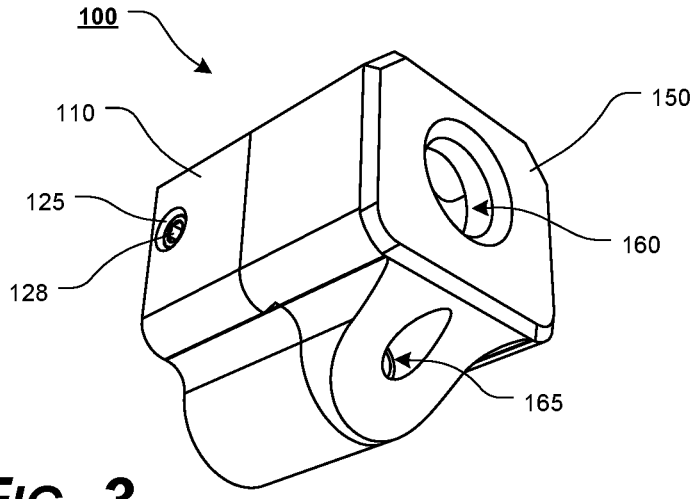
FIG. 3 illustrates a lower, front perspective view of an exemplary embodiment of a modular muzzle device adapter system, according to the present disclosure.
Figure 4:
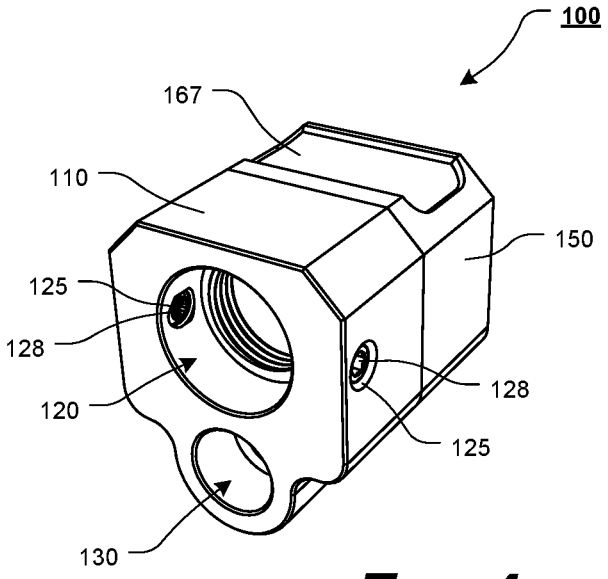
FIG. 4 illustrates a lower, rear perspective view of an exemplary embodiment of a modular muzzle device adapter system, according to the present disclosure.
Figure 5:
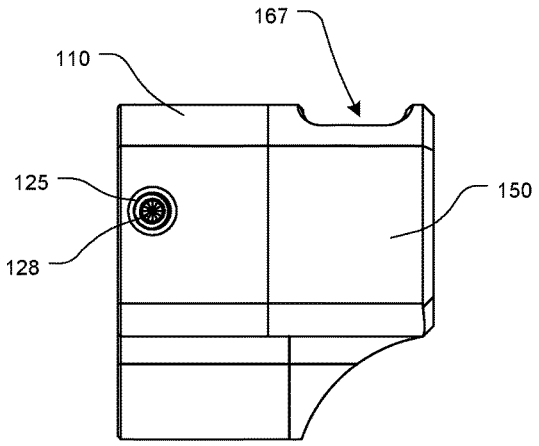
FIG. 5 illustrates a right side view of an exemplary embodiment of a modular muzzle device adapter system, according to the present disclosure.
Figure 6:
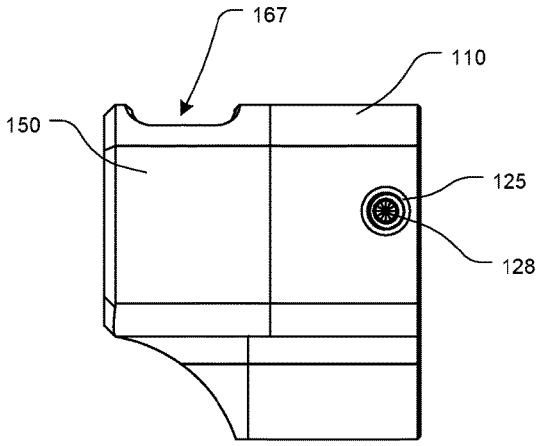
FIG. 6 illustrates a left side view of an exemplary embodiment of a modular muzzle device adapter system, according to the present disclosure.
Figure 7:
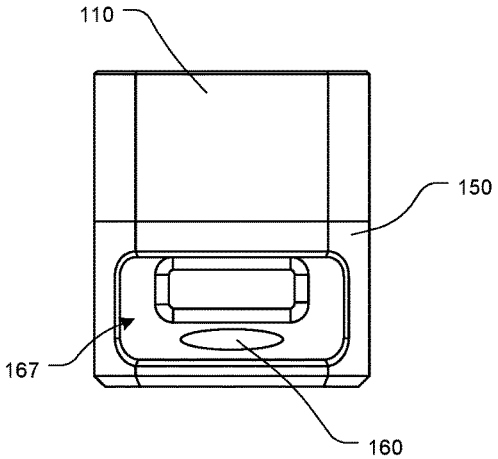
FIG. 7 illustrates a top view of an exemplary embodiment of a modular muzzle device adapter system, according to the present disclosure.
Figure 8:
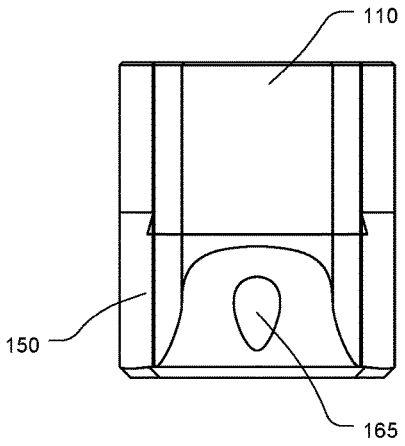
FIG. 8 illustrates a bottom view of an exemplary embodiment of a modular muzzle device adapter system, according to the present disclosure.
Figure 9:
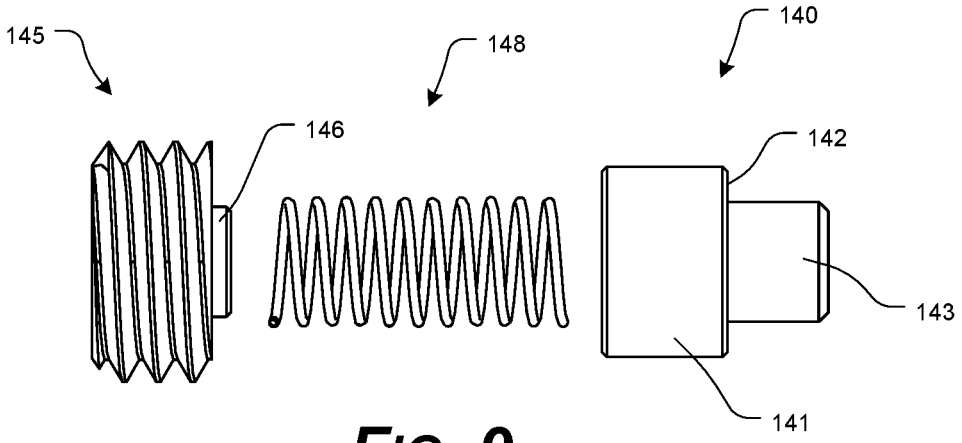
FIG. 9 illustrates an exploded, side view of an exemplary embodiment of various detent components of a modular muzzle device adapter system, according to the present disclosure.
Figure 10:
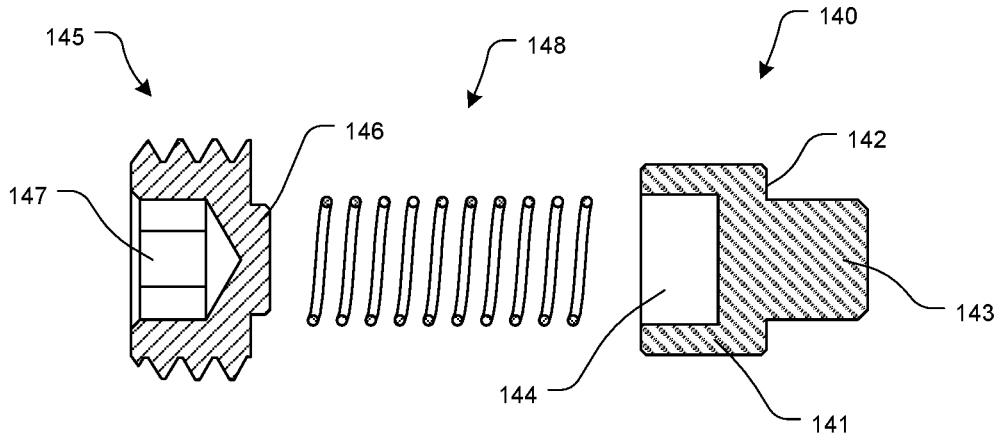
FIG. 10 illustrates an exploded, side, cross-sectional view of an exemplary embodiment of various detent components of a modular muzzle device adapter system, according to the present disclosure.
Figure 11:
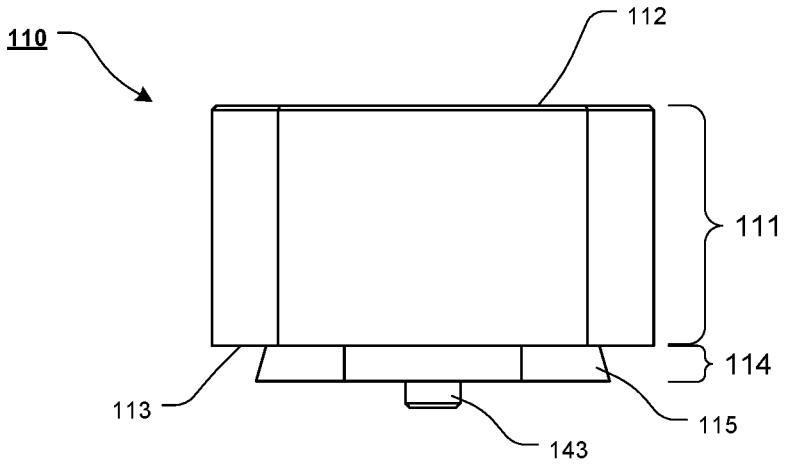
FIG. 11 illustrates a top view of an exemplary embodiment of an adapter, according to the present disclosure.
Figure 12:
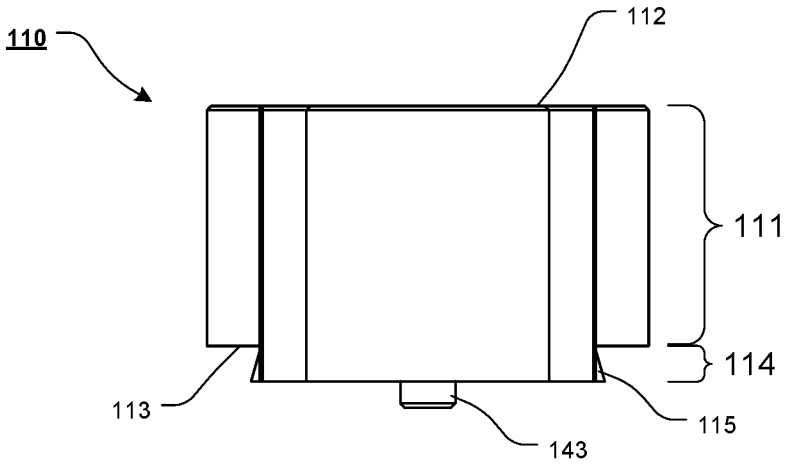
FIG. 12 illustrates a bottom view of an exemplary embodiment of an adapter, according to the present disclosure.
Figure 13:
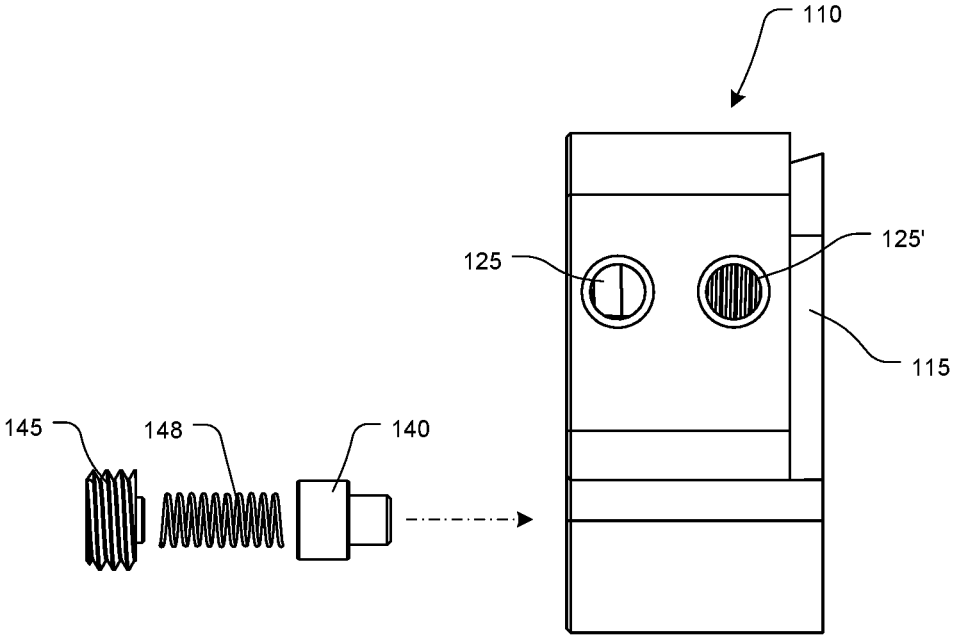
FIG. 13 illustrates a partially exploded, right side view of an exemplary embodiment of an adapter, according to the present disclosure.
Figure 14:
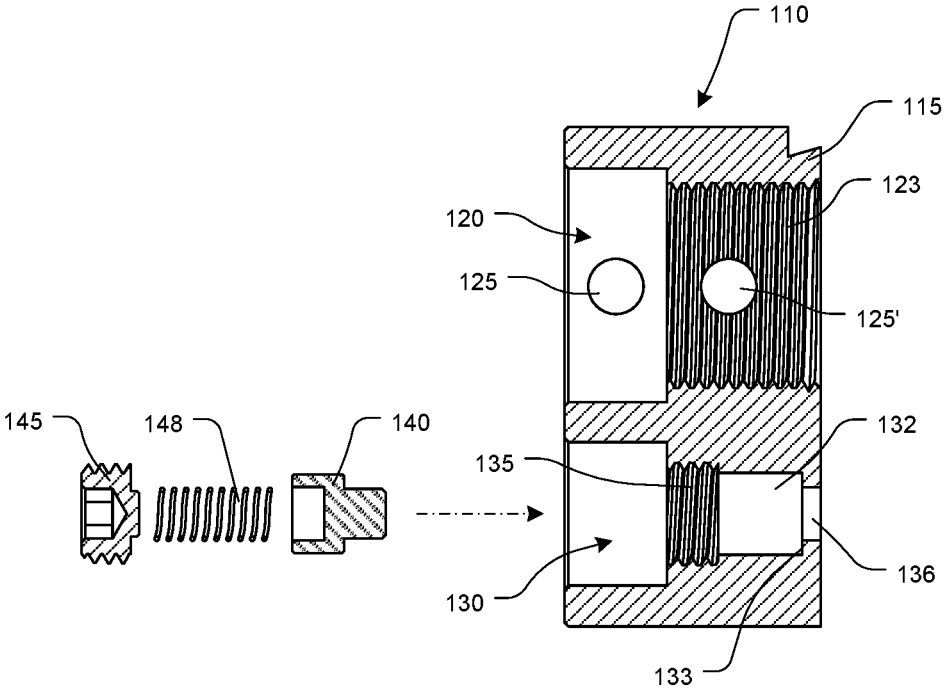
FIG. 14 illustrates a partially exploded, right side, cross-sectional view of an exemplary embodiment of an adapter, according to the present disclosure.

The foregoing and other objectives, features, and advantages of the invention will be more readily understood upon consideration of the following description of the invention taken in conjunction with the accompanying drawings.

For simplicity and clarification, the design factors and operating principles of the modular muzzle device adapter system according to the presently disclosed systems, methods, and/or apparatuses are explained with reference to various exemplary embodiments of a modular muzzle device adapter system according to the presently disclosed systems, methods, and/or apparatuses. The basic explanation of the design factors and operating principles of the modular muzzle device adapter system is applicable for the understanding, design, and operation of the modular muzzle device adapter system of the presently disclosed systems, methods, and/or apparatuses. It should be appreciated that the modular muzzle device adapter system can be adapted to many applications where a modular muzzle device adapter system or muzzle device can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "modular muzzle device adapter system", "muzzle device", "adapter", "firearm barrel", and "firearm" are used for basic explanation and understanding of the operation of the presently disclosed systems, methods, and/or apparatuses. Therefore, the terms "modular muzzle device adapter system", "muzzle device", "adapter", "firearm barrel", and "firearm" are not to be construed as limiting the systems, methods, and/or apparatuses of the present disclosure. Thus, for example, the term "muzzle device" is to be understood to broadly include any compensators, flash hiders, suppressors, bayonets, lights, front sights, camera modules, or other devices or tools that a user may wish to attach or couple to a firearm barrel.

For simplicity and clarification, the modular muzzle device adapter system of the present disclosure will be described as being used in conjunction with a firearm barrel. However, it should be appreciated that these are merely exemplary embodiments of the modular muzzle device adapter system and are not to be construed as limiting the presently disclosed systems, methods, and/or apparatuses. Thus, the modular muzzle device adapter system of the present disclosure may be utilized in conjunction with any firearm barrel or device.

Turning now to the drawing FIGS., FIGS. 1-30 illustrate certain elements and/or aspects of an exemplary embodiment of a modular muzzle device adapter system 100, according to the present disclosure, while FIGS. 31-55 illustrate certain elements and/or aspects of an exemplary embodiment of a modular muzzle device adapter system 100, according to the present disclosure.

In the form of the present disclosure chosen for purposes of illustration, FIGS. 1-30 show various exploded, partially exploded, and assembled views of the modular muzzle device adapter system 100, removed from a firearm. In illustrative, non-limiting embodiment(s) of the present disclosure, as illustrated in FIGS. 1-30, the modular muzzle device adapter system 100 comprises at least some of an adapter 110 (having an adapter body portion 111 and an adapter projection portion 114) and an exemplary muzzle device 150 (having a muzzle device body portion 151 and a muzzle device recess 155). The muzzle device 150 is repeatably securable to and removable from the adapter 110, via at least some interaction between the adapter projection portion 114 of the adapter 110 and the muzzle device recess 155 of the muzzle device 150.

As illustrated most clearly in FIGS. 11-17, the adapter 110 includes an adapter body portion 111 that extends from a proximal end 112 to a distal end 113. The adapter 110 has an adapter projection 115 formed in the adapter projection portion 114 of the adapter 110. The muzzle device 150 is formed with muzzle device recess 155, which mates with the adapter projection 115. In various exemplary, nonlimiting embodiments, the adapter projection 115 is a dovetail adapter projection 115 and the muzzle device recess 155 in the muzzle device 150 is a mating, dovetail muzzle device recess 155. More specifically, the illustrated adapter projection 115 is a 3-sided dovetail adapter projection 115 and the muzzle device recess 155 in the muzzle device 150 is a 3-sided dovetail muzzle device recess 155.

It should be appreciated that, in various exemplary embodiments, the adapter projection 115 merely comprises a 2-sided dovetail projection, wherein the dovetail projections are on opposing sides relative to one another. In these embodiments, the muzzle device recess 155 comprises a mating, 2-sided dovetail recess.

The adapter 110 includes an adapter barrel aperture 120 that is formed so as to extend through the adapter 110, from the proximal end 112 to the distal end 113, parallel to a longitudinal axis, $A_L$, of the adapter 110. In certain exemplary embodiments, a barrel aperture threaded portion 123 is formed in at least a portion of the adapter barrel aperture 120. The barrel aperture threaded portion 123, if included, is formed so as to interact with a threaded portion of a firearm barrel, so that the adapter 110 can be utilized in conjunction with a standard firearm barrel and installed in a fashion similar to that of a standard threaded muzzle device.

In various exemplary embodiments, one or more fastening element apertures 125 may be formed through at least a portion of the adapter body portion 111, proximate the non-threaded portion of the adapter barrel aperture 120. Alternatively, one or more fastening element apertures 125 are formed through at least a portion of the adapter body portion 111, within the barrel aperture threaded portion 123 (as illustrated by fastening element apertures 125').

Each fastening element aperture 125 is formed so as to allow a fastening element 128 to extend through the adapter body portion 111 and into the adapter barrel aperture 120.

It should be appreciated that the number and position of fastening element apertures 125 and associated fastening elements 128 is a design choice. Therefore, one or more fastening element apertures 125 may be positioned, as desired, relative to the adapter 110.

In certain exemplary embodiments, the barrel aperture threaded portion 123 is not included, and the adapter 110 is attached or coupled to a firearm barrel, which may or may not include external barrel threads, via interaction of frictional engagement between the interior walls of the adapter barrel aperture 120 and the one or more fastening elements 128.

In various exemplary embodiments, as illustrated herein, the fastening element 128 comprises a screw and each fastening element aperture 125 comprises an internally threaded or at least partially internally threaded aperture. It should be appreciated that in other exemplary embodiments, the fastening element 128 may comprise, for example, a roll pin and each fastening element aperture 125 may comprise a non-threaded aperture sized so as to receive and be frictionally engaged with the roll pin.

In various exemplary embodiments, the fastening elements 128 are screwed into the adapter 110 from the outside of the adapter 110, toward the inside of the adapter 110. Alternatively, the fastening elements 128 may be screwed into the adapter 110 from the inside of the adapter 110, toward the outside of the adapter 110.

In various exemplary embodiments, when the adapter 110 is threadably secured to an exemplary firearm barrel 190 (via interaction of the external muzzle threads 194 of the firearm barrel 190 and the internal threads of the barrel aperture threaded portion 123), the adapter 110 may optionally be further secured to the firearm barrel 190 via frictional engagement between the firearm barrel 190 and one or more fasteners 128 extending at least partially into the adapter barrel aperture 120.

In certain exemplary embodiments, the external muzzle threads 194 of the firearm barrel 190 may include one or more flats 195 formed within the external muzzle threads 194 or purpose milled flat areas 193 formed in the firearm barrel body 192 of the 190 firearm barrel 190, so as to interact with the fasteners 128. In this manner, the fasteners 128 are able to interact with flat portions of the firearm barrel 190 in a more secure manner and are able to interact without disrupting or marring the external muzzle threads 194 of the firearm barrel 190. Alternatively, the fasteners 128 may interact with the external muzzle threads 194 or round side portions of the firearm barrel body 192.

In various exemplary embodiments, an end portion of the fastener 128 may optionally include a sacrificial element 129, such as, for example, a brass, Teflon, plastic, rubber, or other element. If included, the sacrificial element 129 allows the fastener 128 to be urged against a portion of the firearm barrel body 192 and/or external muzzle threads 194, without marring or damaging the firearm barrel body 192 or the external muzzle threads 194.

In various exemplary embodiments, the adapter 110 may include one or more internal tabs that engage your interface to relief cuts on the barrel, to prevent the adapter 110 from rotating, for example, when the muzzle device 150 is attached to or removed from the adapter 110. It should be appreciated that the number of fasteners 128 may optionally correspond to the number of internal tabs.

The adapter 110 includes an adapter detent aperture 130 that is formed so as to extend through the adapter 110, from the proximal end 112 to the distal end 113. In various exemplary embodiments, the adapter detent aperture 130 is also formed parallel to a longitudinal axis $A_L$ of the adapter 110, at a distance spaced apart from the adapter barrel aperture 120.

The adapter detent aperture 130 extends from the proximal end 112 to a detent aperture threaded portion 135. The detent aperture threaded portion 135 includes internal threads, formed so as to interact with external threads of the detent plug 145. The adapter detent aperture 130 continues to extend from the detent aperture threaded portion 135, through a detent body aperture portion 132, to a detent aperture shoulder 133. The adapter detent aperture 130 continues to extend from the detent aperture shoulder 133 to a detent head aperture portion 136. The detent head aperture portion 136 extends to the distal end 113.

In various exemplary embodiments, the adapter detent aperture 130 has a first inner diameter as the adapter detent aperture 130 extends from the detent aperture threaded portion 135, through the detent body aperture portion 132, to the detent aperture shoulder 133. The detent aperture shoulder 133 is formed within the adapter detent aperture 130 and the adapter detent aperture 130 has a second, smaller, inner diameter as the adapter detent aperture 130 extends from the detent aperture shoulder 133, through the detent head aperture portion 136, to the distal end 113.

In various exemplary, nonlimiting environments, the modular muzzle device adapter system 100 includes a detent 140. The detent 140 includes a detent body 141 that extends to a detent shoulder 142. A detent head 143 extends from the detent shoulder 142 of the detent head 141. The detent head 143 has a smaller external diameter than the external diameter of the detent body 141. A detent recess 144 is formed within the detent body 141, so as to accept at least a portion of a spring tension element at least partially therein.

A detent plug 145 includes an externally threaded portion, with external threads formed so as to interact with the internal threads of the detent aperture threaded portion 135. A detent plug projection 146 extends from a portion of the detent plug 145 and is formed so as to be aligned with and aid in maintaining the spring tension element 148 in a desired position relative to the detent plug 145.

In certain exemplary embodiments, the detent 140 includes a detent plug recess 147, which may optionally comprise a hexagonal recess, allowing a hexagonal tool driver to be used to threadably insert or retract the detent plug 145 within the detent aperture threaded portion 135 of the adapter detent aperture 130.

In various exemplary embodiments, the spring tension element 148 comprises a coil spring or other similar element, capable of providing a desired degree of spring tension between the detent 140 and the detent plug 145.

As illustrated most clearly in FIGS. 13-16, the detent 140 is spring biased within the adapter detent aperture 130 by positioning the detent 140 within the detent body aperture portion 132, such that the detent shoulder 142 contact at least a portion of the detent aperture shoulder 133 and at least a portion of the detent head 143 extends through the detent head aperture portion 136. The spring tension element 148 is positioned within the detent body aperture portion 132, such that at least a portion of the spring tension element 148 is positioned within the detent recess 144.

The detent plug 145 is then positioned such that the external threads of the detent plug 145 interact with the detent aperture threaded portion 135, such that rotation of the detent plug 145 secures the detent plug 145 within the detent aperture threaded portion 135. When appropriately secured, the detent plug projection 146 outlines a portion of the spring tension element 148 with the detent plug 145.

Figure 15:
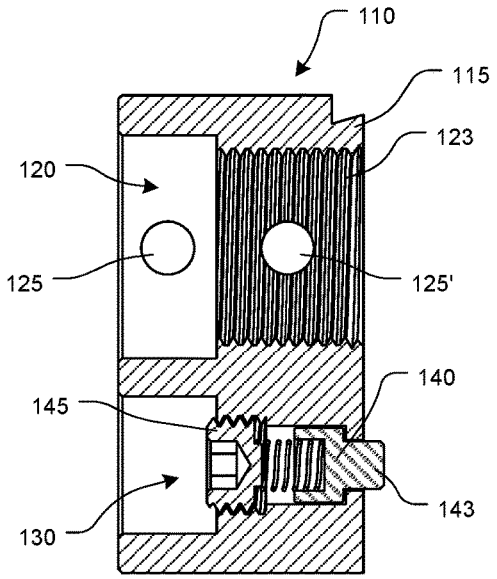
FIG. 15 illustrates a partially exploded, right side, cross-sectional view of an exemplary embodiment of an adapter, according to the present disclosure.
Figure 16:
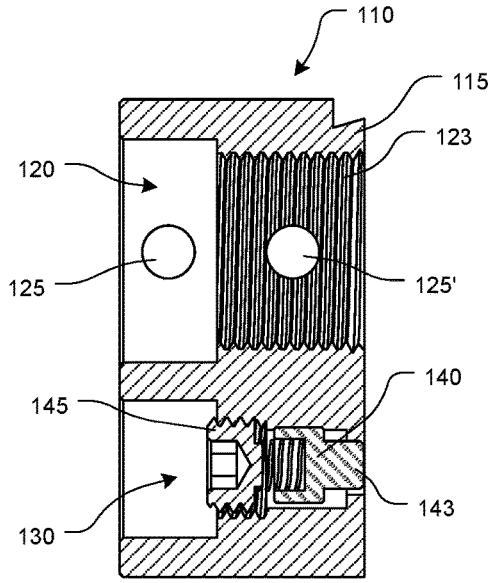
FIG. 16 illustrates a partially exploded, right side, cross-sectional view of an exemplary embodiment of an adapter, according to the present disclosure.
Figure 17:
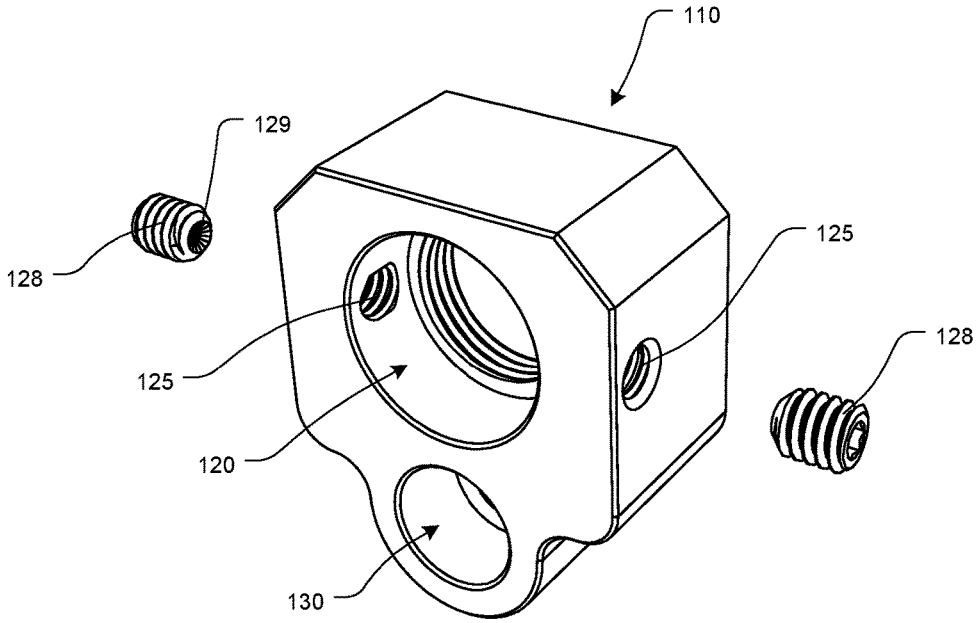
FIG. 17 illustrates an upper, rear, perspective view of an exemplary embodiment of an adapter, according to the present disclosure.
Figure 18:
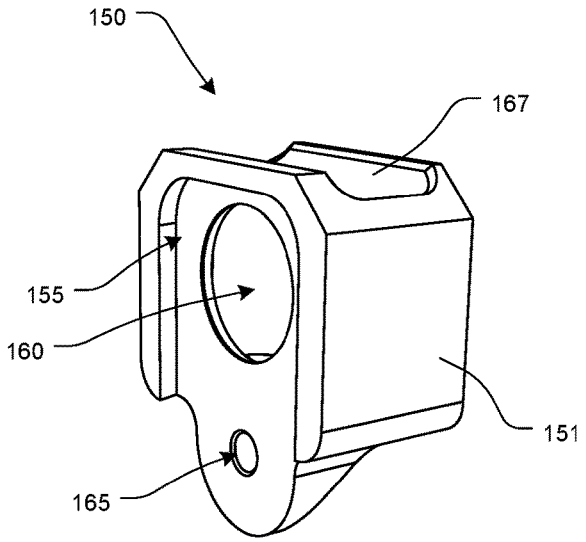
FIG. 18 illustrates a rear, perspective view of an exemplary embodiment of a muzzle device, according to the present disclosure.
Figure 19:
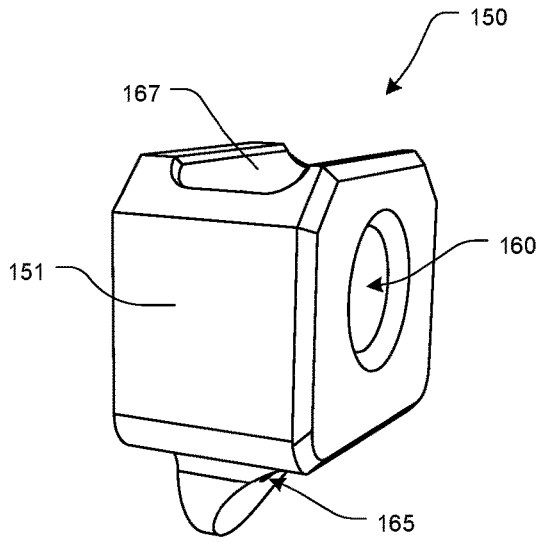
FIG. 19 illustrates a front, perspective view of an exemplary embodiment of a muzzle device, according to the present disclosure.
Figure 20:
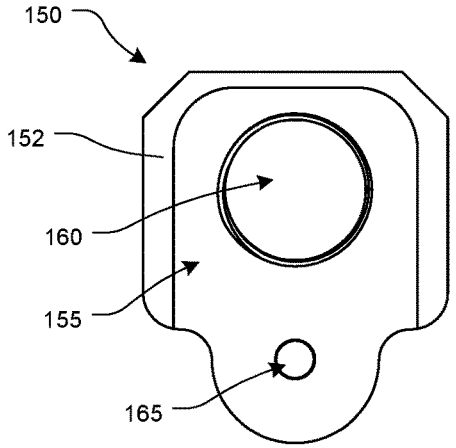
FIG. 20 illustrates a rear view of an exemplary embodiment of a muzzle device, according to the present disclosure.
Figure 21:
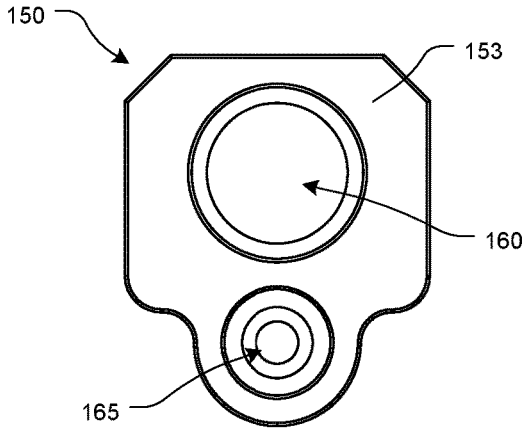
FIG. 21 illustrates a front view of an exemplary embodiment of a muzzle device, according to the present disclosure.
Figure 22:
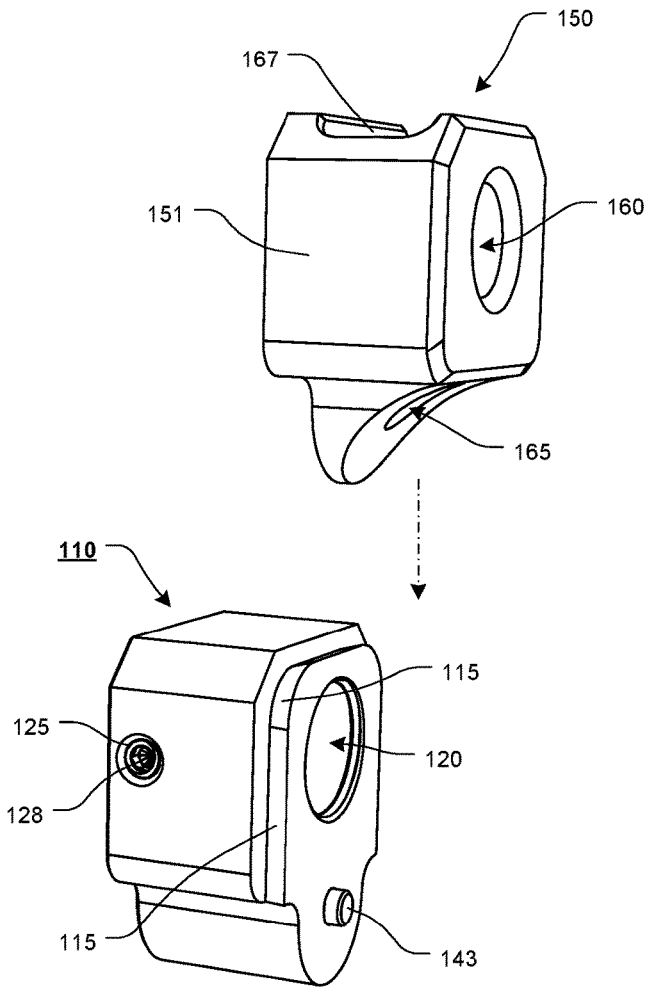
FIG. 22 illustrates a front, perspective view of an exemplary embodiment of a muzzle device aligned with an adapter, according to the present disclosure.
Figure 23:
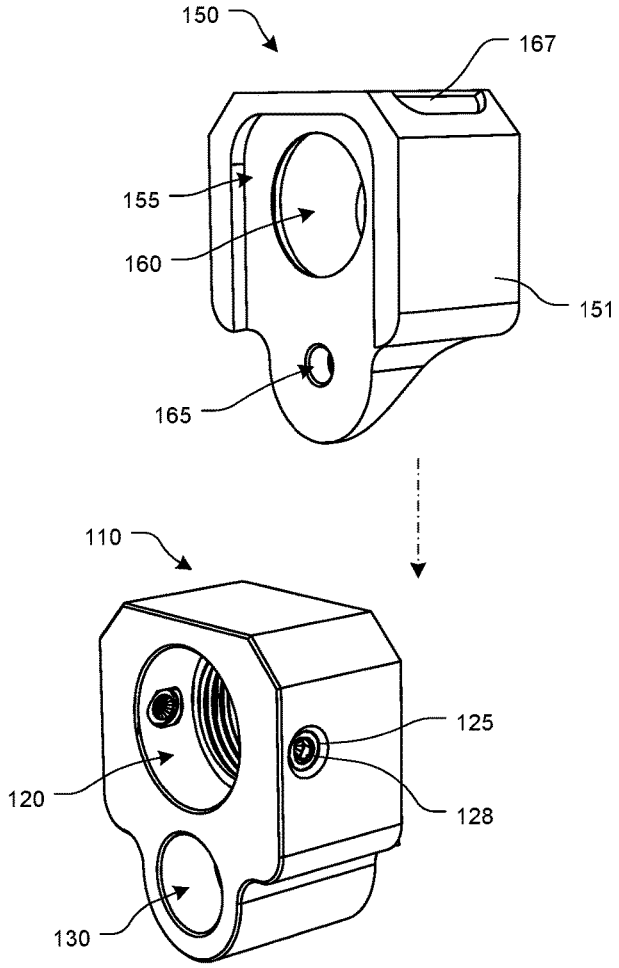
FIG. 23 illustrates a rear, perspective view of an exemplary embodiment of a muzzle device aligned with an adapter, according to the present disclosure.
Figure 24:
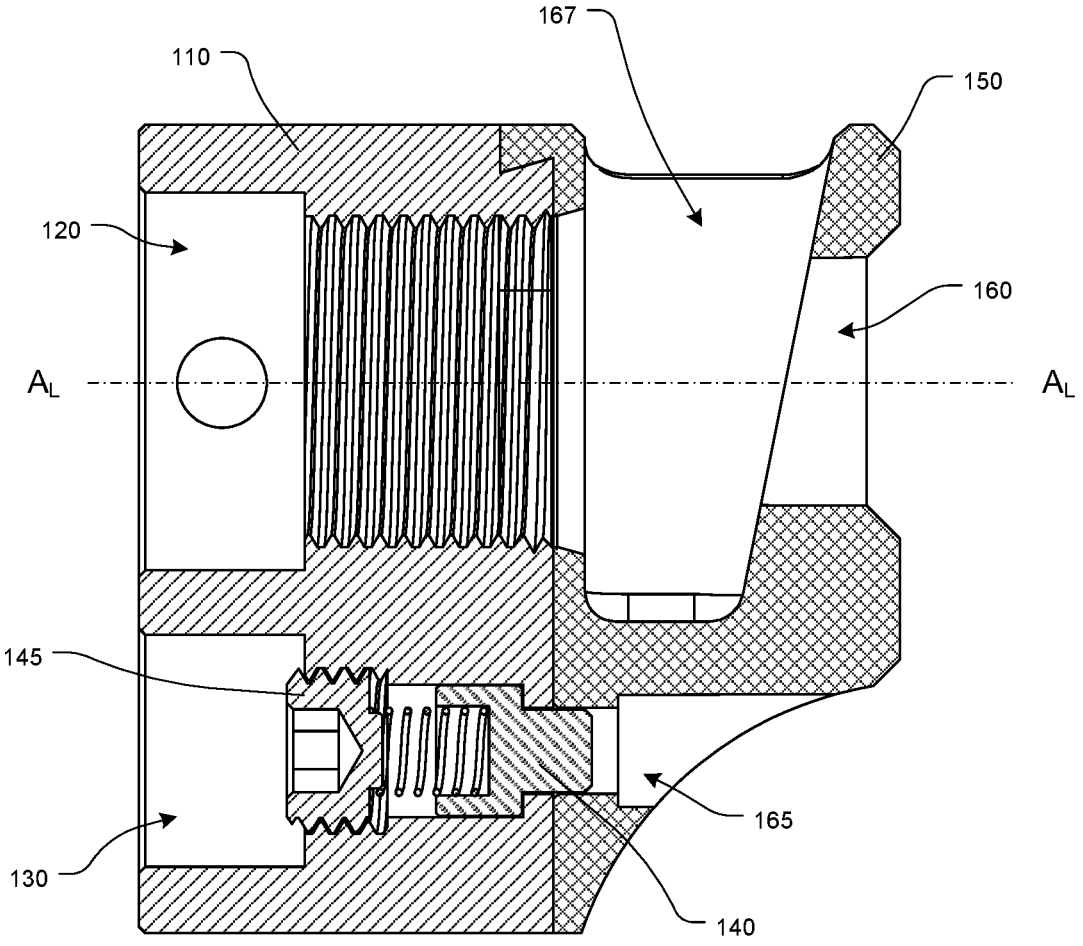
FIG. 24 illustrates a side, cross-sectional view of an exemplary embodiment of a modular muzzle device adapter system, according to the present disclosure.
Figure 25:
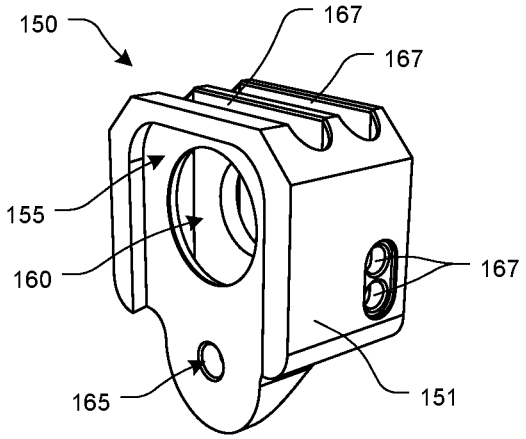
FIG. 25 illustrates a rear, perspective view of an exemplary embodiment of a muzzle device, according to the present disclosure.
Figure 26:
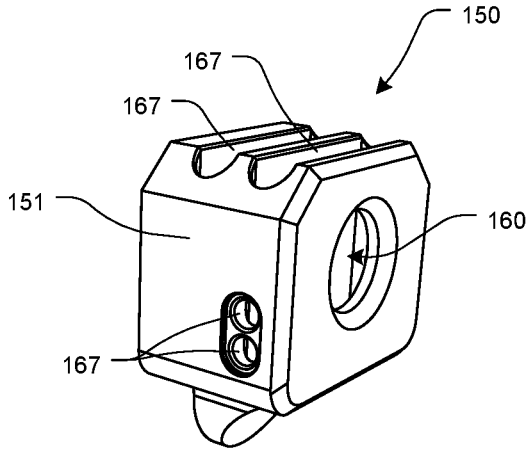
FIG. 26 illustrates a front, perspective view of an exemplary embodiment of a muzzle device, according to the present disclosure.
Figure 27:
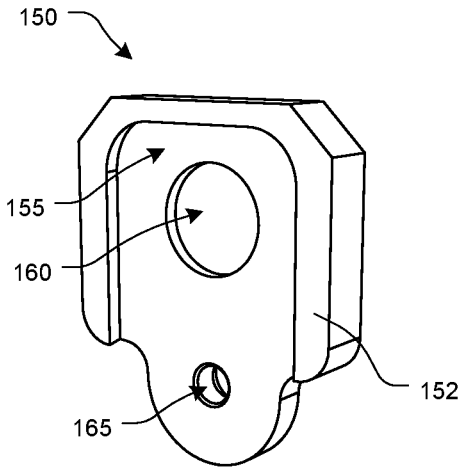
FIG. 27 illustrates a rear, perspective view of an exemplary embodiment of a muzzle device, according to the present disclosure.
Figure 28:
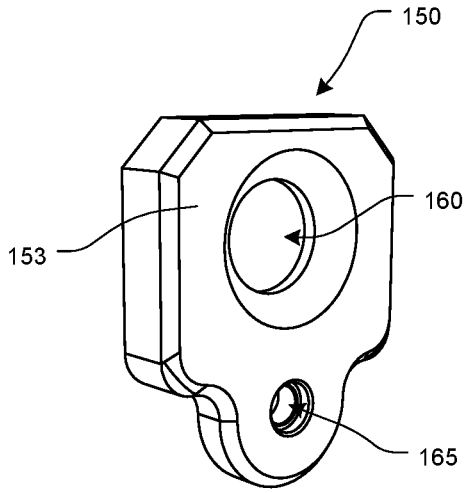
FIG. 28 illustrates a front, perspective view of an exemplary embodiment of a muzzle device, according to the present disclosure.

Once installed, the detent 140 is positioned within the adapter detent aperture 130, such that the detent 140 is slidably positionable between an engaged position (as illustrated in FIG. 15), wherein at least a portion of the detent head 143 extends from the detent head aperture portion 136 and a disengaged position (as illustrated in FIG. 16), wherein the detent head 143 is urged such that a terminal end of the detent 140 is at least flush with the distal end 113 of the adapter 110.

If the detent head 143 is substantially planar, the detent head 143 may need to be physically urged between the engaged position in the disengaged position.

Figure 29:
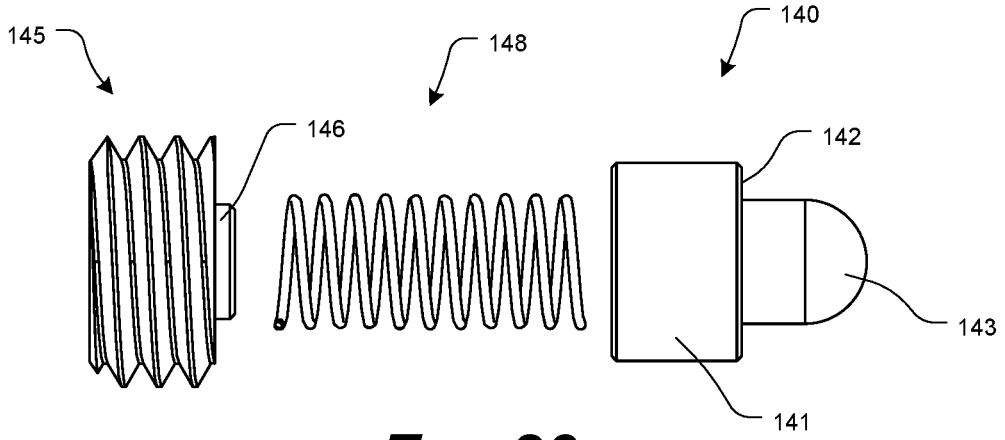
FIG. 29 illustrates an exploded, side view of an exemplary embodiment of various detent components of a modular muzzle device adapter system, according to the present disclosure.
Figure 30:
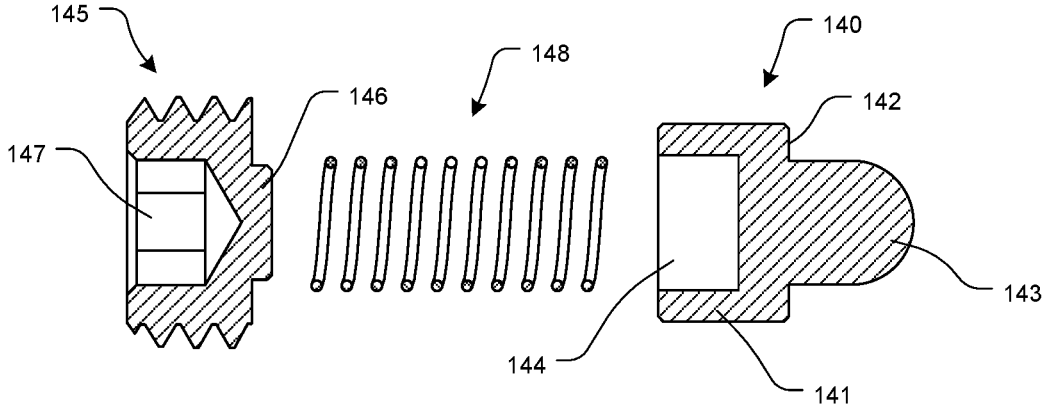
FIG. 30 illustrates an exploded, side, cross-sectional view of an exemplary embodiment of various detent components of a modular muzzle device adapter system, according to the present disclosure.
Figure 31:
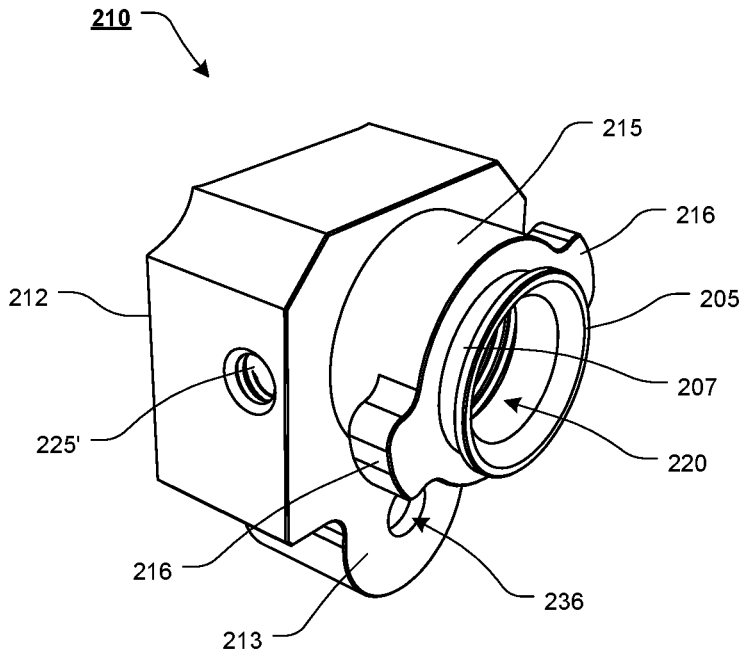
FIG. 31 illustrates an upper, front, perspective view of an exemplary embodiment of an adapter, according to the present disclosure.
Figure 32:
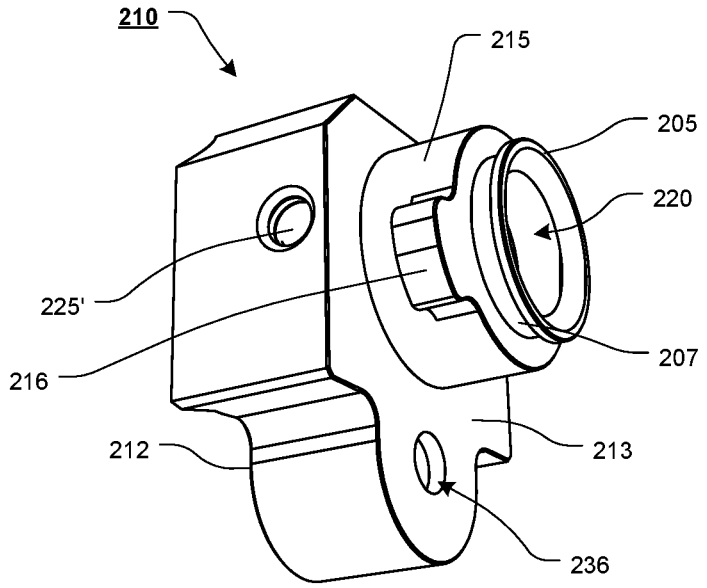
FIG. 32 illustrates a lower, front, perspective view of an exemplary embodiment of an adapter, according to the present disclosure.
Figure 33:
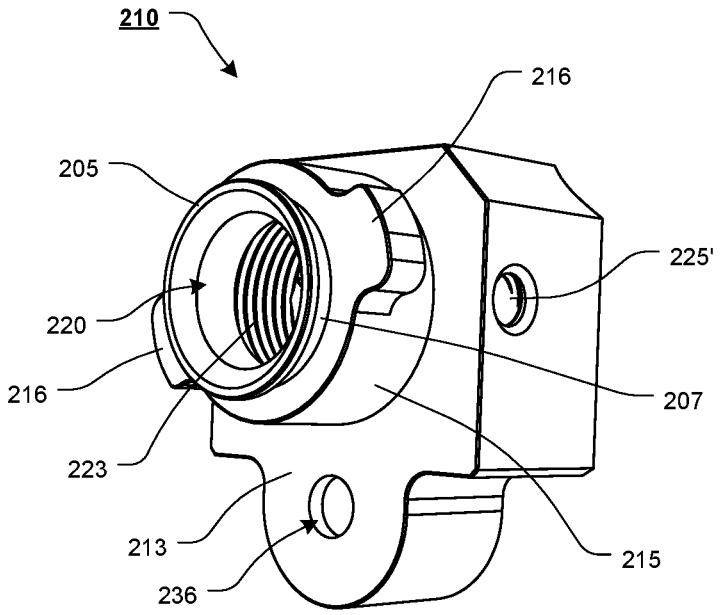
FIG. 33 illustrates a front, perspective view of an exemplary embodiment of an adapter, according to the present disclosure.
Figure 34:
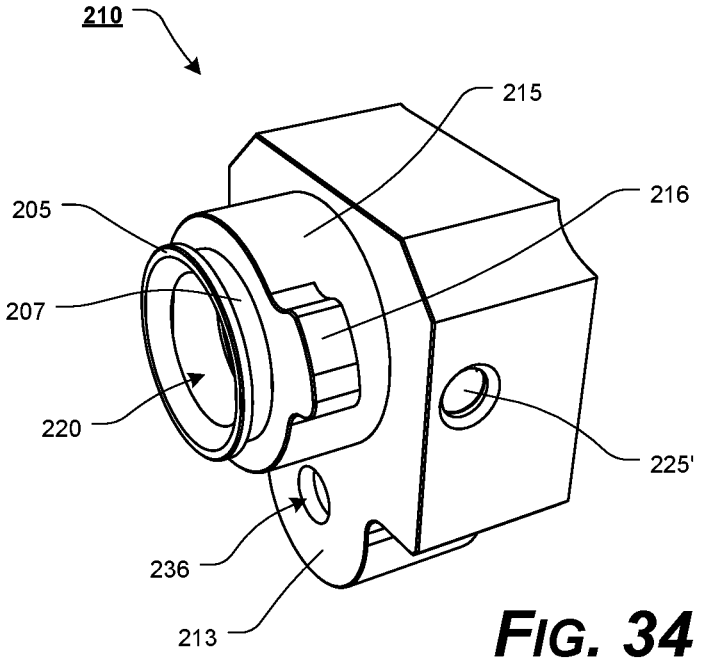
FIG. 34 illustrates an upper, front, perspective view of an exemplary embodiment of an adapter, according to the present disclosure.
Figure 35:
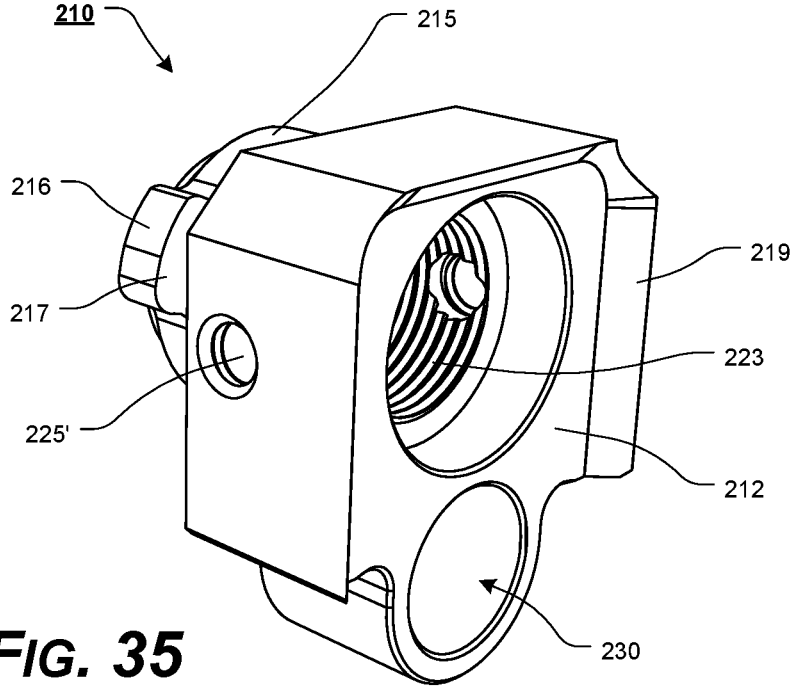
FIG. 35 illustrates a left, rear, perspective view of an exemplary embodiment of an adapter, according to the present disclosure.
Figure 36:
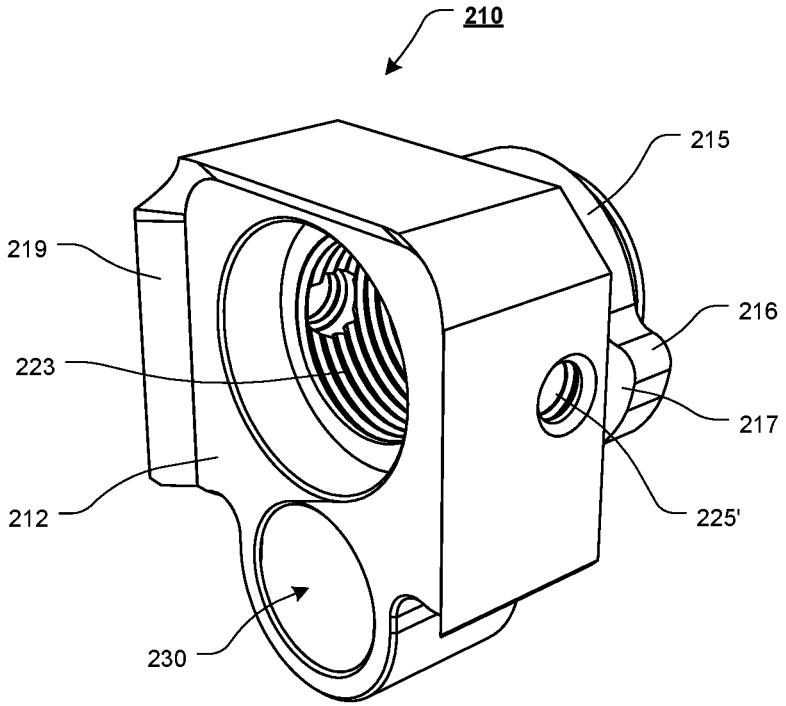
FIG. 36 illustrates a right, rear, perspective view of an exemplary embodiment of an adapter, according to the present disclosure.
Figure 37:
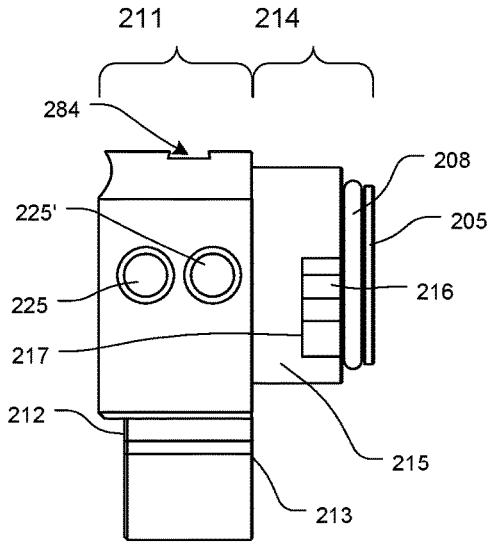
FIG. 37 illustrates a right side view of an exemplary embodiment of an adapter, according to the present disclosure.
Figure 38:
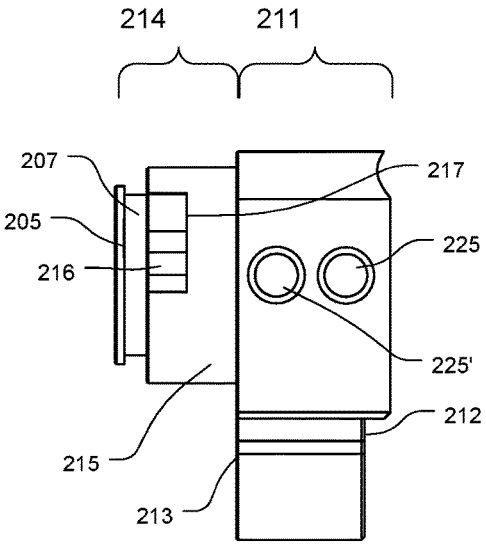
FIG. 38 illustrates a left side view of an exemplary embodiment of an adapter, according to the present disclosure.
Figure 39:
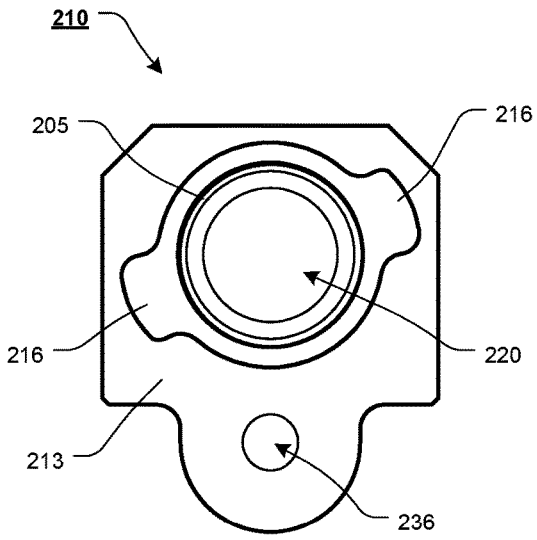
FIG. 39 illustrates a front view of an exemplary embodiment of an adapter, according to the present disclosure.
Figure 40:
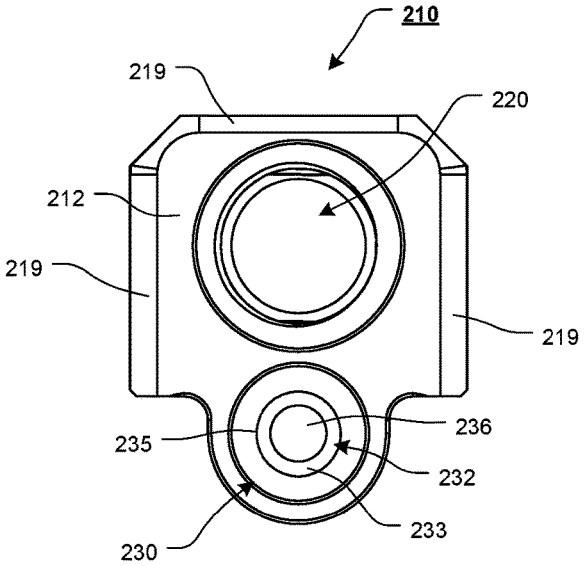
FIG. 40 illustrates a rear view of an exemplary embodiment of an adapter, according to the present disclosure.
Figure 41:
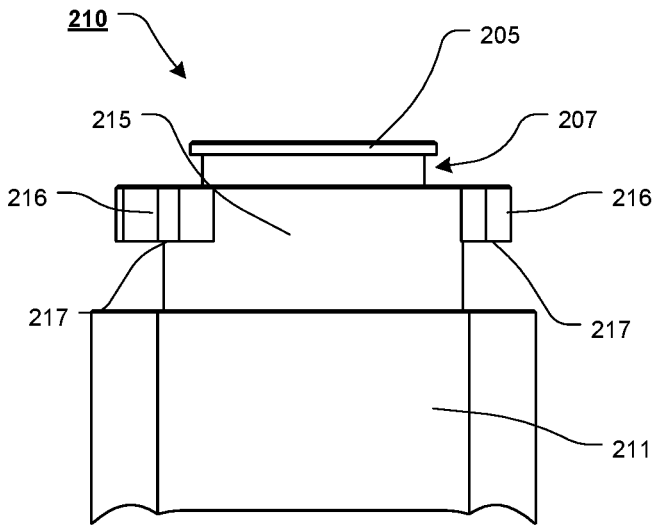
FIG. 41 illustrates a top view of an exemplary embodiment of an adapter, according to the present disclosure.
Figure 42:
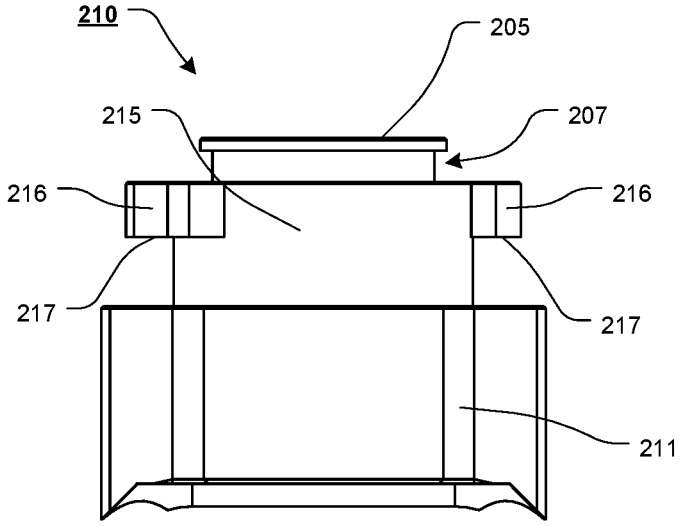
FIG. 42 illustrates a bottom view of an exemplary embodiment of an adapter, according to the present disclosure.
Figure 43:
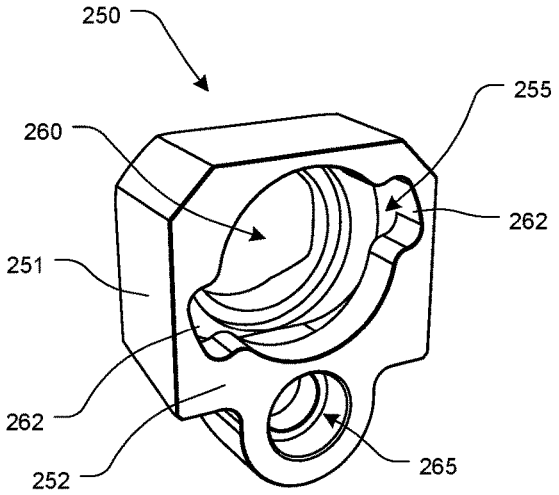
FIG. 43 illustrates a left, rear, perspective view of an exemplary embodiment of a muzzle device, according to the present disclosure.
Figure 44:
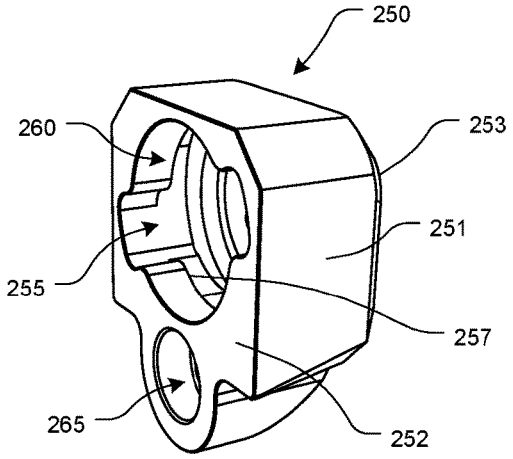
FIG. 44 illustrates a right, rear, perspective view of an exemplary embodiment of a muzzle device, according to the present disclosure.
Figure 45:
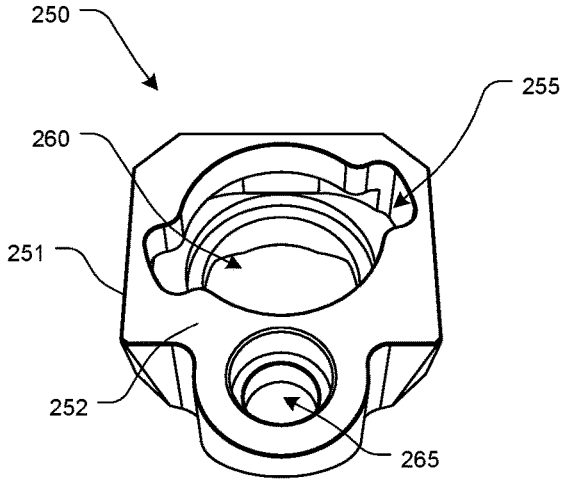
FIG. 45 illustrates a bottom, perspective view of an exemplary embodiment of a muzzle device, according to the present disclosure.
Figure 46:
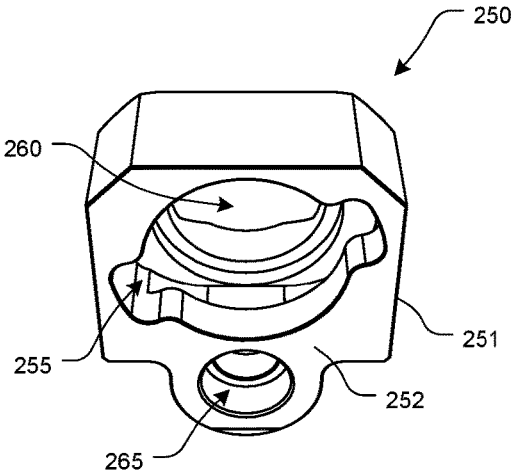
FIG. 46 illustrates a top, perspective view of an exemplary embodiment of a muzzle device, according to the present disclosure.
Figure 47:
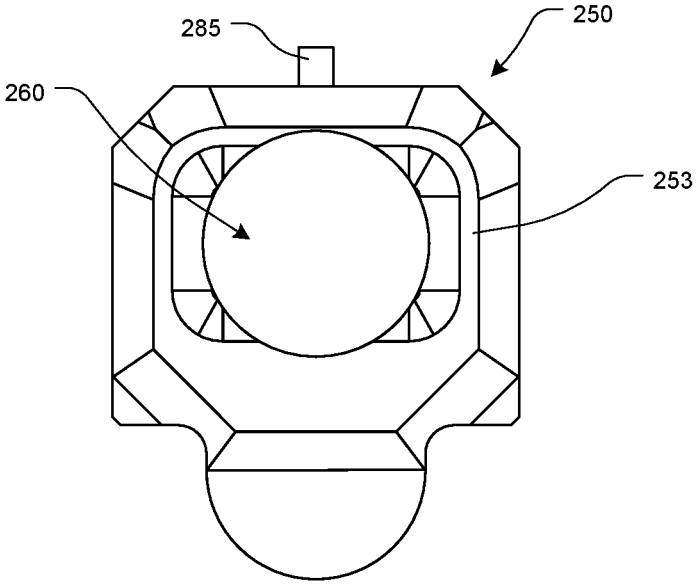
FIG. 47 illustrates a front view of an exemplary embodiment of a muzzle device, according to the present disclosure.
Figure 48:
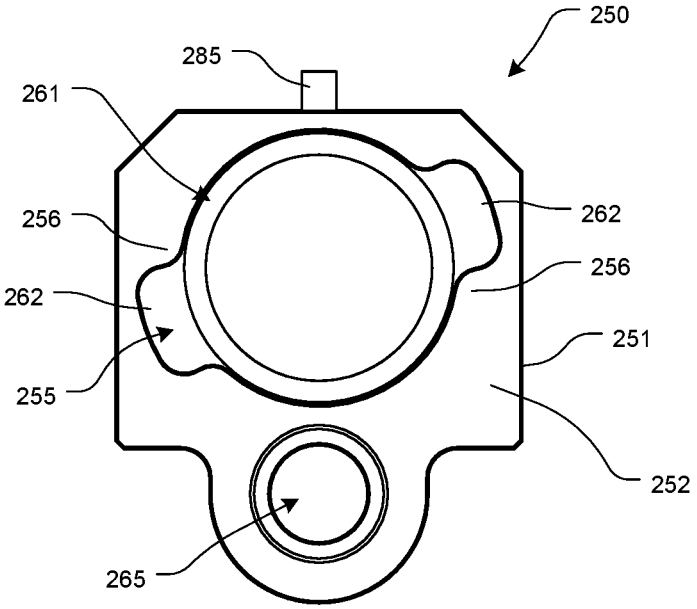
FIG. 48 illustrates a rear view of an exemplary embodiment of a muzzle device, according to the present disclosure.
Figure 49:
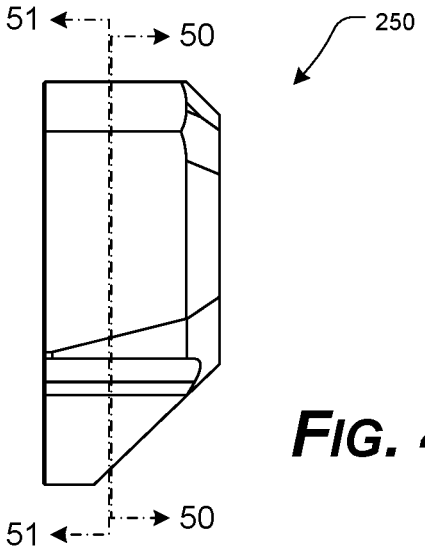
FIG. 49 illustrates a right side view of an exemplary embodiment of a muzzle device, according to the present disclosure.
Figure 50:
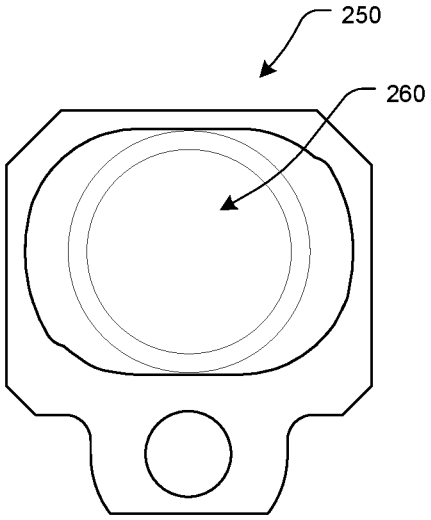
FIG. 50 illustrates a cross-sectional view, taken along line 50-50 of FIG. 49, of an exemplary embodiment of a muzzle device, according to the present disclosure.
Figure 51:
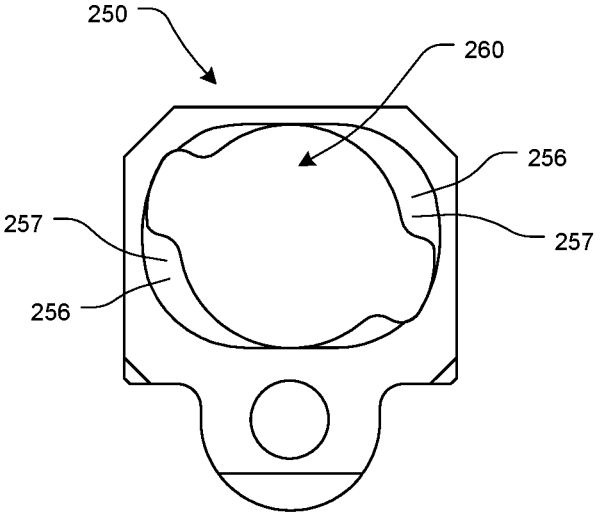
FIG. 51 illustrates a cross-sectional view, taken along line 51-51 of FIG. 49, of an exemplary embodiment of a muzzle device, according to the present disclosure.

In certain alternative embodiments, as illustrated in FIGS. 29-30, at least a portion of the detent head 143 is rounded or spherical, such that contact between a portion of the detent head 143 and the muzzle device 150 may urge the detent 140 from engaged position to a disengaged position.

Thus, a detent 140 having a substantially rounded detent head 143 helps to lock the muzzle device 150 relative to the adapter 110 and also allows for quick twist off of the muzzle device 150 from the adapter 110.

It should also be appreciated that in certain exemplary embodiments, the detent 140 may be a fixed bolt or fastener that maintains the muzzle device 150 relative to the adapter 110.

In various exemplary embodiments, the muzzle device 150 includes a muzzle device body portion 151 that extends from an adapter end 152 to a muzzle end 153. The muzzle device 150 has a muzzle device recess 155 formed in at least a portion of the muzzle device 150, extending from the adapter end 152. The muzzle device recess 155 is formed so as to be optionally slidable or otherwise mateable with the adapter projection 115. Thus, when assembled, the muzzle device 150 is slidably secured to the end of the adapter 110 via interaction of the adapter projection 115 and the muzzle device recess 155.

In various exemplary, nonlimiting embodiments, the adapter projection 115 is a dovetail adapter projection 115 and the muzzle device recess 155 in the muzzle device 150 is a mating, dovetail muzzle device recess 155. More specifically, the illustrated adapter projection 115 is a 3-sided dovetail adapter projection 115 and the muzzle device recess 155 in the muzzle device 150 is a 3-sided dovetail muzzle device recess 155.

It should be appreciated that, in various exemplary embodiments, the adapter projection 115 merely comprises a 2-sided dovetail projection, wherein the dovetail projections are on opposing sides relative to one another. In these embodiments, the muzzle device recess 155 comprises a mating, 2-sided dovetail recess.

Alternatively, the adapter projection 115 and the mating muzzle device recess 155 may comprise mating dovetail projection and recess elements, mating 2 or 3 plug projections and recesses, mating ratchet elements, gear elements, and the like. Thus, it should be appreciated that the adapter projection 115 and the mating muzzle device recess 155 may optionally be any known or later developed mateable pair of projections, recesses, or other elements.

The muzzle device 150 includes a muzzle device aperture 160 that is formed so as to extend through the muzzle device 150, from the adapter end 152 to the muzzle end 153, parallel to a longitudinal axis, $A_L$, of the muzzle device 150. When the muzzle device 150 is appropriately attached or coupled to the adapter 110, the muzzle device aperture 160 is aligned with the adapter barrel aperture 120, so that a projectile leaving and attached or coupled firearm barrel is able to pass through the aligned adapter barrel aperture 120 and muzzle device aperture 160.

The muzzle device 150 includes a muzzle device detent aperture 165 that is formed so as to extend through the muzzle device 150, from the adapter end 152 to the muzzle end 153. In various exemplary embodiments, the muzzle device detent aperture 165 is also formed parallel to a longitudinal axis $A_L$ of the muzzle device 150, at a distance spaced apart from the muzzle device aperture 160.

The muzzle device detent aperture 165 is formed so as to receive at least a portion of the detent head 143 of the detent 140 at least partially therein. In this manner, when at least a portion of the detent head 143 extends or protrudes from the distal end 113 of the adapter 110, at least a portion of the detent head 143 is able to at least partially extend or protrude within the muzzle device detent aperture 165. Thus, interaction between at least a portion of the detent head 143 and the muzzle device detent aperture 165 assist in maintaining the relative position of the muzzle device 150 to the adapter 110.

In various exemplary embodiments, the muzzle device 150 optionally includes one or more apertures or muzzle device ports 167 are drilled or otherwise formed through a portion of the muzzle device body portion 151. In various exemplary embodiments, the muzzle device ports 167 extend from a portion of the muzzle device aperture 160, to the outer surface of the muzzle device body portion 151. If the muzzle device ports 167 are tapered, they may optionally be tapered outward as they extend from the muzzle device aperture 160 or may be tapered inward as they extend from the muzzle device aperture 160. Each of the mitigation muzzle device ports 167 provides fluid communication between at least a portion of the muzzle device aperture 160 and the exterior of the muzzle device 150.

By incorporating one or more muzzle device ports 167, as the propellant gases exit the muzzle device aperture 160, at least a portion of the propellant gases is directed through the muzzle device ports 167 to counteract the force of recoil or muzzle rise of the firearm.

It should be appreciated that a variety of muzzle devices 150 may be used in connection with the adapter 110, thus making the adapter 110 and the modular muzzle device adapter system 100 modular. FIGS. 25-28 illustrates certain exemplary embodiments of muzzle devices 150 that may be utilized in connection with the adapter 110. However, it should be appreciated that the muzzle devices that may optionally be utilized in connection with the adapter 110 are not limited to the illustrated muzzle devices 150 and may optionally include compensators, flash hiders, suppressors, bayonets, lights, front sights, camera module, and the like.

Additionally, a front sight may optionally be included as part of an exemplary muzzle device 150 or may optionally be attached or coupled to an exemplary muzzle device 150 (such as, for example, the front sight 285). In this manner, the sight radius of a firearm may be extended to provide increased aiming accuracy for the firearm.

In various exemplary embodiments, certain components of the modular muzzle device adapter system 100 are substantially rigid and are formed of aluminum. Alternate materials of construction of the various components of the modular muzzle device adapter system 100 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the modular muzzle device adapter system 100 is a design choice based on the desired appearance and functionality of the modular muzzle device adapter system 100.

It should be appreciated that certain elements of the modular muzzle device adapter system 100 may be formed as an integral unit (such as, for example, the adapter body portion 111 and the adapter projection portion 114). Alternatively, suitable materials can be used and sections or elements made independently and attached or coupled together, such as by adhesives, welding, screws, rivets, pins, or other fasteners, to form the various elements of the modular muzzle device adapter system 100.

It should also be understood that the overall size and shape of the modular muzzle device adapter system 100 and the various portions thereof, such as, for example, the adapter 110 and/or the muzzle device 150, is a design choice based upon the desired functionality and/or appearance of the modular muzzle device adapter system 100.

During installation of the modular muzzle device adapter system 100, a terminal end of a firearm barrel is positioned within the adapter barrel aperture 120 of the adapter 110 and the external threads of the firearm barrel contact the internal threads of the barrel aperture threaded portion 123. As the adapter 110 is rotated relative to the firearm barrel, the external threads of the firearm barrel interact with the internal threads of the barrel aperture threaded portion 123 to secure the adapter 110 to the firearm barrel.

When the adapter 110 is appropriately secured to the firearm barrel, one or more fasteners 128 may be utilized, via the fastening element apertures 125, to further secure the adapter 110 to the firearm barrel. If included, interaction between the one or more fasteners 128 and the firearm barrel further resist rotation of the adapter 110 relative to the firearm barrel. Thus, the adapter 110 resist rotation, during use.

In various exemplary embodiments, the adapter 110 is formed such that installation of the adapter 110 on a firearm barrel is necessary in order to install the firearm barrel in the firearm slide.

When the adapter 110 is appropriately secured to the firearm barrel, a selected muzzle device 150 may be attached or coupled to the adapter 110, via interaction of the adapter projection portion 114 and the muzzle device recess 155. During attachment of the muzzle device 150, the muzzle device 150 is aligned with the adapter 110, such that an open portion of the muzzle device recess 155 is aligned with the adapter projection 115 of the adapter projection portion 114. Once appropriately aligned, the muzzle device 150 is slidably urged relative to the adapter 110, such that the adapter projection 115 is slidably positioned within the muzzle device recess 155.

As the muzzle device 150 is slidably urged within the muzzle device recess 155, a portion of the muzzle device 150 contacts the detent head 143 of the detent 140. If the detent head 143 is substantially planar, the detent 140 may need to be physically urged from the engaged position to the disengaged position. Alternatively, if the detent head 143 is substantially rounded or spherical, continued urging of the muzzle device 150 relative to the adapter 110 may urge the detent 140 from the engaged position to the disengaged position.

Once the spring bias of the spring tension element 148 is appropriately overcome and the detent 140 is urged from the engaged to the disengaged position (wherein the detent 140 is slidably urged into at least a portion of the detent body aperture portion 132), the muzzle device 150 can be slidably positioned relative to the adapter 110. When the muzzle device 150 is in a determined, attached position, the spring bias of the spring tension element 148 urges at least a portion of the detent head 143 of the detent body 140 from at least a portion of the detent head aperture portion 136 to interact with and be at least partially captured within a portion of the muzzle device detent aperture 165 of the muzzle device 150 to maintain the muzzle device 150 in a desired position relative to the adapter 110. Thus, when appropriately assembled, the muzzle device 150 is slidably secured proximate the distal end 113 of the adapter 110 via interaction of the rejection 115 and the muzzle device recess 155.

To remove the muzzle device 150 from the adapter 110, the detent 140 is urged from the engaged position to the disengaged position. If the terminal end of the detent head 143 is substantially flat or planar, the detent 140 can be accessed, via the muzzle device detent aperture 165.

If the terminal end of the detent head 143 is substantially circular spherical, it may not be necessary to access the detent 140, via a muzzle device detent aperture 165. In these exemplary environments, the muzzle device detent aperture 165 may not extend completely through the muzzle device 150, but may only extend partially through the muzzle device 150, from the adapter end 152.

Once the detent 140 has been urged from the engaged position to the disengaged position, the muzzle device 150 is slidable, relative to the adapter 110, to be removed from the adapter 110.

FIGS. 31-59 illustrate certain elements and/or aspects of an exemplary embodiment of a modular muzzle device adapter system 200, according to the present disclosure. As illustrated in FIGS. 31-59, the modular muzzle device adapter system 200 comprises at least some of an adapter 210, an adapter body portion 211, a proximal end 212, a distal end 213, an adapter barrel aperture 220, an optional barrel aperture threaded portion 223, one or more fastening element apertures 225 and/or 225', one or more fasteners 229 (not shown), an adapter detent aperture 230, a detent aperture threaded portion 235, a detent body aperture portion 232, a detent aperture shoulder 233, a detent head aperture portion 236, a detent 240, a detent body 241, a detent head 243, a detent shoulder 242, a detent recess 244, a detent plug 245, a detent plug projection 246, a detent plug recess 247, a spring tensioning element 248, a muzzle device 250, a muzzle device body portion 251, an adapter end 252, a muzzle end 253, a muzzle device aperture 260, a muzzle device detent aperture 265, and one or more optional muzzle device ports 267.

It should be understood that each of these components and/or elements correspond to and operate similarly to the adapter 110, the adapter body portion 111, the proximal end 112, the distal end 113, the adapter barrel aperture 120, the optional barrel aperture threaded portion 123, the one or more fastening element apertures 125 and/or 125', the one or more fasteners 128, the adapter detent aperture 130, the detent aperture threaded portion 135, the detent body aperture portion 132, the detent aperture shoulder 133, the detent head aperture portion 136, the detent 140, the detent body 141, the detent head 143, the detent shoulder 142, the detent recess 144, the detent plug 145, the detent plug projection 146, the detent plug recess 147, the spring tensioning element 148, the muzzle device 150, the muzzle device body portion 151, the adapter end 152, the muzzle end 153, the muzzle device aperture 160, the muzzle device detent aperture 165, and the one or more optional muzzle device ports 167, as described above with reference to the modular muzzle device adapter system 100.

However, as illustrated in FIGS. 31-59, the adapter projection 115 of the adapter projection portion 114 and the muzzle device recess 155 of the modular muzzle device adapter system 100 are replaced by an adapter projection 215 of an adapter projection portion 214, and a muzzle device recess 255 of the modular muzzle device adapter system 200. The muzzle device 250 is repeatably securable to and removable from the adapter 210, via at least some interaction between the adapter projection portion 214 of the adapter 210 and the muzzle device recess 255 of the muzzle device 250.

As illustrated, the adapter 210 has an adapter projection 215 formed in the adapter projection portion 214. The adapter projection 215 comprises a substantially cylindrical extension from the distal end of the adapter body portion 211. In various exemplary embodiments, at least a portion of the barrel aperture threaded portion 223 extends into at least a portion of the adapter projection 215.

One or more projection locking extensions 216 extend from opposing sides of the adapter projection 215, proximate a terminal end of the adapter projection 215. The projection locking extensions 216 are comparatively more narrow than the remaining portion of the adapter projection 215 and an outer diameter of the adapter projection 215 is sized and shaped so as to be urged through a corresponding muzzle device aperture opening 261 of the muzzle device recess 255. A muzzle device capture shoulder 217 is formed by each projection locking extension 216, between each projection locking extension 216 and the distal end 213 of the adapter 210.

In certain exemplary embodiments, the adapter projection 215 extends to include an adapter mating projection 205. The adapter mating projection 205 optionally includes an O-ring recess 207 formed so as to receive and maintain an O-ring 208 within the O-ring recess 207. If included, the O-ring 208 helps to provide an improved seal between the adapter 210 and the muzzle device 250, when the muzzle device 250 is attached or coupled to the adapter 210. In this manner, carbon build-up is kept out of the interface between the adapter 210 and the muzzle device 250. This is an improvement over typical quick detach or fixed mount muzzle devices, which can become stuck on the firearm barrel and cannot be removed, due to gas leak and carbon build-up that seize the threads or lugs. In various exemplary embodiments, one or more 0-ring recesses 207 can be provided. The O-ring 208 may be formed of any desired material and may be flexible, semirigid, or rigid (i.e., for example may optionally be a metal gas ring).

The muzzle device aperture 260 of the muzzle device 250 includes a larger diameter muzzle device aperture opening 261 extending from the adapter end 252, having with two, comparatively more narrow keyhole slots 262 that extend from opposing sides of the muzzle device aperture opening 261. The muzzle device aperture openings 261 are formed by muzzle device locking extensions 256.

The muzzle device recess 255 is formed within a portion of the muzzle device 250. In various exemplary embodiments, the muzzle device recess 255 has a first inner diameter as the muzzle device recess 255 extends from the muzzle device aperture opening 261, toward the muzzle end 253. The muzzle device locking extensions 256 extend into at least a portion of the muzzle device recess 255 and the muzzle device recess 255 has a second inner diameter as the muzzle device recess 255 extends from the muzzle device locking extensions 256 to the muzzle end 253.

The projection locking extensions 216 of adapter projection 215 are sized and shaped so as to be urged through the keyhole slots 262. Thus, the exterior shape of the adapter projection 215 substantially corresponds to the shape of the muzzle device recess 255.

In certain exemplary embodiments, the exterior shape of the adapter projection 215 may not correspond to the shape of the muzzle device recess 255, but is of a size and shape so as to be urged through at least a portion of the keyhole slot 262.

While the muzzle device aperture opening 261 is shown as having a substantially circular muzzle device aperture opening 261 and rounded keyhole slots 262, it should be appreciated that the muzzle device aperture opening 261 may comprise a muzzle device aperture opening 261 having a square, rectangular, triangular, or any other overall shape. Likewise, the keyhole slots 262 may comprise slots having a square, rectangular, triangular, or other overall shape. Thus, the muzzle device aperture opening 261 and the keyhole slots 262 are formed so as to allow the adapter projection 215 and the projection locking extensions 216 to pass therethrough, when appropriately aligned.

It should be appreciated that the number, size, and placement of the projection locking extensions 216 and corresponding keyhole slots 262 is a design choice and can be varied.

Once the adapter 210 is attached or coupled to a firearm barrel, a desired muzzle device 250 may be rotatably attached or coupled to the adapter 210.

During attachment or coupling of the muzzle device 250, the muzzle device 250 is rotated relative to the adapter 210, such that the adapter projection 215 and the projection locking extensions 216 are aligned with the muzzle device aperture opening 261 and the keyhole slots 262, such that the adapter projection 215 is able to pass through the muzzle device aperture opening 261 and the projection locking extensions 216 are able to pass through the keyhole slots 262.

As the muzzle device 250 continues to be urged toward the adapter 210, the projection locking extensions 216 pass through the keyhole slots 262 until the projection locking extensions 216 are within the muzzle device recess 255. Once the projection locking extensions 216 are appropriately positioned within the muzzle device recess 255, the muzzle device 250 is rotated relative to the adapter 210, such that the muzzle device capture shoulder 217 contacts and engages at least a portion of the muzzle device locking extension shoulder 257.

The muzzle device 250 is then rotated such that the muzzle device 250 is rotationally aligned with the adapter 210 and the detent head 243 of the detent 240 is aligned with the muzzle device detent aperture 265 of the muzzle device 250 is aligned with the detent head aperture portion 236 of the adapter 210. Once appropriately aligned, the detent 240 is able to act as an additional indexing device to prevent the muzzle device 250 from rotating relative to the adapter 110, thus assist in maintaining the rotational relationship between the muzzle device 250 and the adapter 210.

When the adapter 210 is appropriately secured to the firearm barrel, a selected muzzle device 250 may be attached or coupled to the adapter 210, via interaction of the adapter projection portion 214 and the muzzle device recess 255. During attachment of the muzzle device 250, as the muzzle device 250 is rotatably urged within the muzzle device recess 255, a portion of the muzzle device 250 contacts the detent head 243 of the detent 240. If the detent head 243 is substantially planar, the detent 240 may need to be physically urged from the engaged position to the disengaged position. Alternatively, if the detent head 243 is substantially rounded or spherical, continued rotational urging of the muzzle device 250 relative to the adapter 210 may urge the detent 240 from the engaged position to the disengaged position.

Once the spring bias of the spring tension element 248 is appropriately overcome and the detent 240 is urged from the engaged to the disengaged position (wherein the detent 240 is rotationally urged into at least a portion of the detent body aperture portion 232), the muzzle device 250 can be rotationally positioned relative to the adapter 210. When the muzzle device 250 is in a determined, rotational position, the spring bias of the spring tension element 248 urges at least a portion of the detent head 243 of the detent body 240 from at least a portion of the detent head aperture portion 236 to interact with and be at least partially captured within a portion of the muzzle device detent aperture 265 of the muzzle device 250 to maintain the muzzle device 250 in a desired position relative to the adapter 210. Thus, when appropriately assembled, the muzzle device 250 is rotationally secured proximate the distal end 213 of the adapter 210 via interaction of the rejection 215 and the muzzle device recess 255.

To remove the muzzle device 250 from the adapter 210, the detent 240 is urged from the engaged position to the disengaged position. If the terminal end of the detent head 243 is substantially flat or planar, the detent 240 can be accessed, via the muzzle device detent aperture 265.

If the terminal end of the detent head 243 is substantially circular spherical, it may not be necessary to access the detent 240, via a muzzle device detent aperture 265. In these exemplary environments, the muzzle device detent aperture 265 may not extend completely through the muzzle device 250, but may only extend partially through the muzzle device 250, from the adapter end 252.

Once the detent 240 has been urged from the engaged position to the disengaged position, the muzzle device 250 is rotatable, relative to the adapter 210, to be removed from the adapter 210.

Thus, the muzzle device 250 can be rotated between an unlocked position and a locked position. When the muzzle device 250 is in the unlocked position, the adapter projection 215 aligns with the muzzle device aperture opening 261 and the projection locking extensions 216 align with keyhole slots 262, to allow the muzzle device 250 to be unattached or removed from the adapter 210. When the muzzle device 250 is in the locked position, the projection locking extensions 216 are misaligned with keyhole slots 262 and the muzzle device capture shoulder 217 contacts and engages at least a portion of the muzzle device locking extension shoulder 257 to keep the muzzle device 250 attached or coupled to the adapter 210.

In various exemplary embodiments, a flange 219 extends from a portion of the proximal end 212, proximate a perimeter of at least a portion of the adapter 210. The flange 219, if included, is formed so as to allow at least a portion of the proximal end 212 of the adapter 210 to have a smoother transition between the adapter 210 and a portion of the slide of the firearm, when the firearm is in battery. In this manner, a gap between the terminal end of the slide and the proximal end 212 of the adapter 210 is minimized.

In various exemplary embodiments, a front sight 285 may optionally be included as part of an exemplary muzzle device 250 (or adapter 210) or may optionally be attached or coupled to an exemplary muzzle device 250 (or adapter 210). By including a front sight 285 on the muzzle device 250, the sight radius of a firearm may be extended to provide increased sight alignment and aiming accuracy for the firearm. In certain alternative embodiments, the front sight 285 may optionally be included as part of or attached or coupled to the adapter 210.

In certain exemplary embodiments, a dovetail or other sight recess 284 may be formed in a portion of the adapter 210 (or the adapter 110) to allow a front sight to be installed on the adapter 210 (or the adapter 110).

Figure 52:
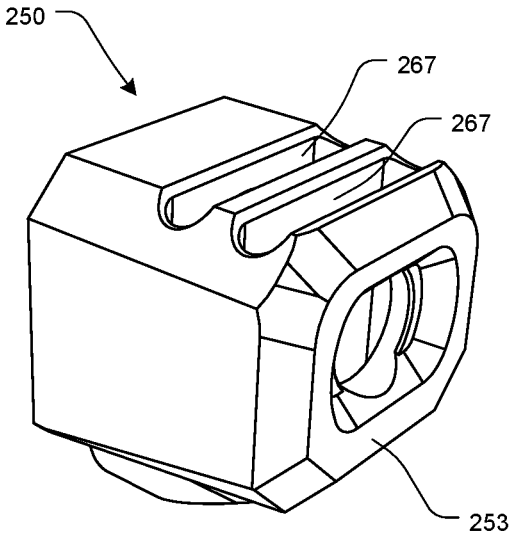
FIG. 52 illustrates an upper, right, perspective view of an exemplary embodiment of a muzzle device, according to the present disclosure.
Figure 53:
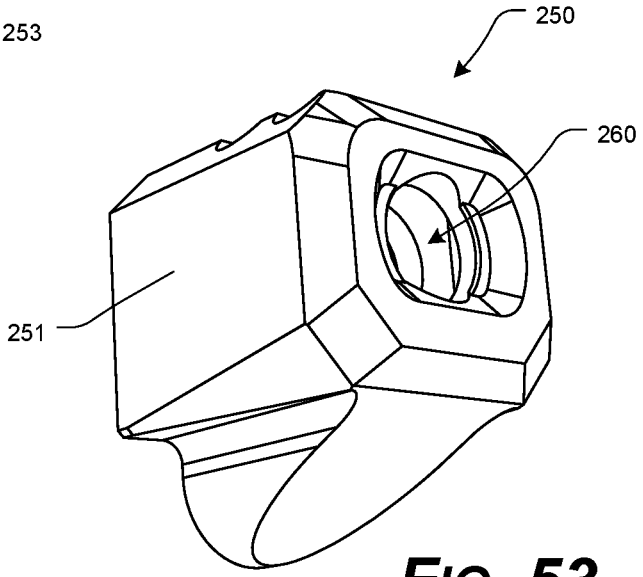
FIG. 53 illustrates a lower, right, perspective view of an exemplary embodiment of a muzzle device, according to the present disclosure.
Figure 54:
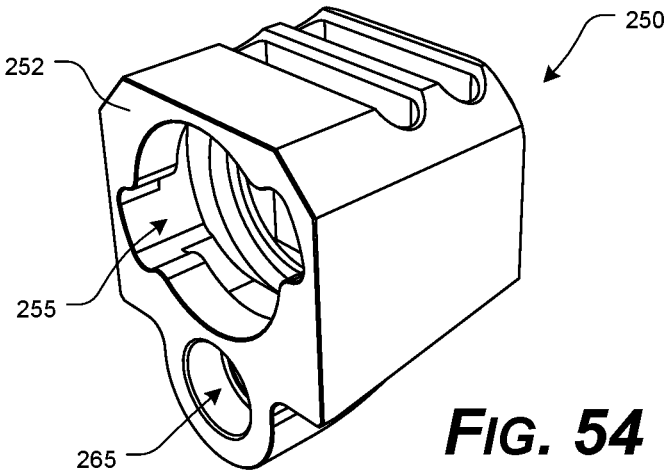
FIG. 54 illustrates an upper, rear, perspective view of an exemplary embodiment of a muzzle device, according to the present disclosure.
Figure 55:
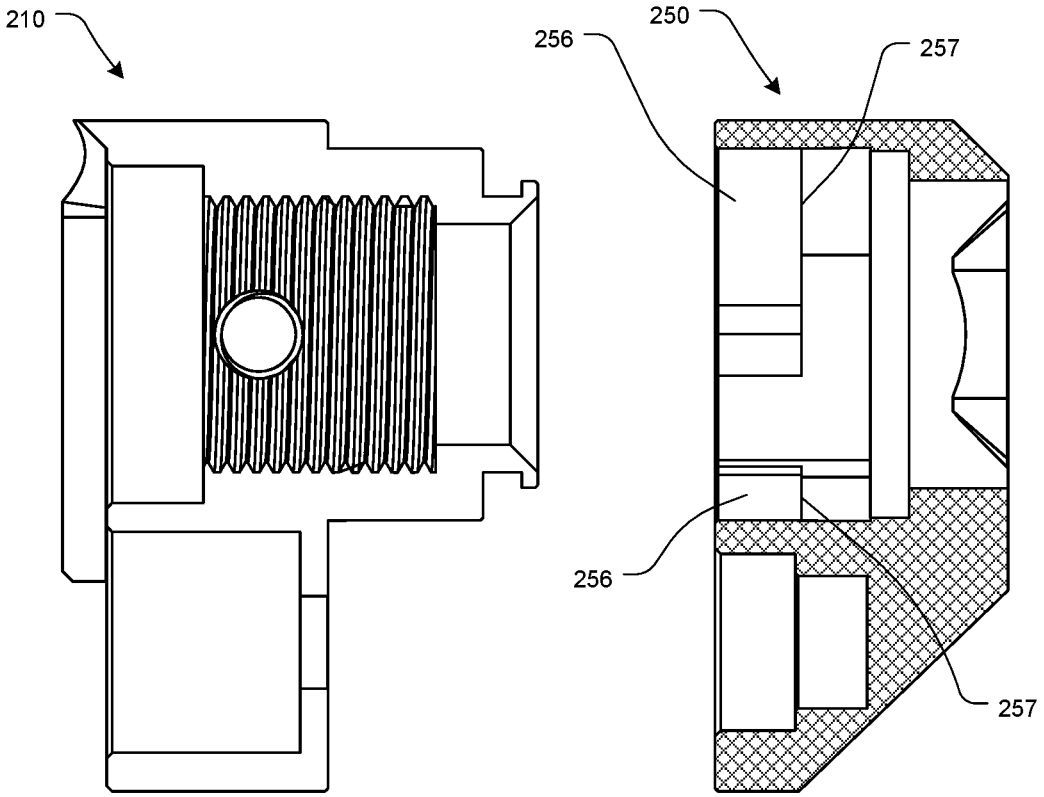
FIG. 55 illustrates an exploded, cross-sectional view of certain exemplary components of an exemplary embodiment of a modular muzzle device adapter system, according to the present disclosure.
Figure 56:
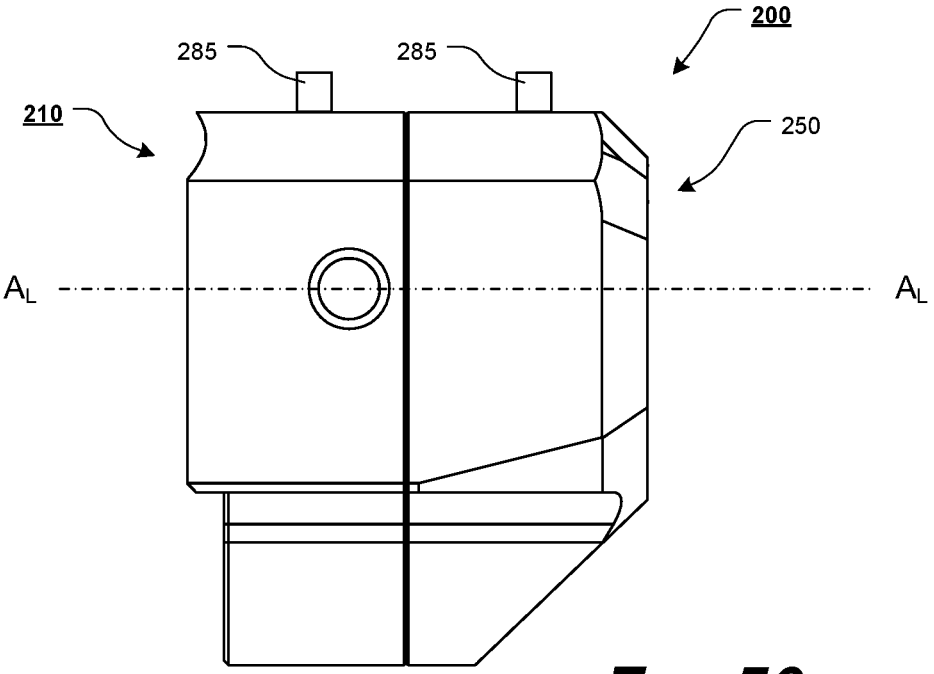
FIG. 56 illustrates a right side view of certain exemplary components of an exemplary embodiment of a modular muzzle device adapter system, according to the present disclosure.
Figure 57:
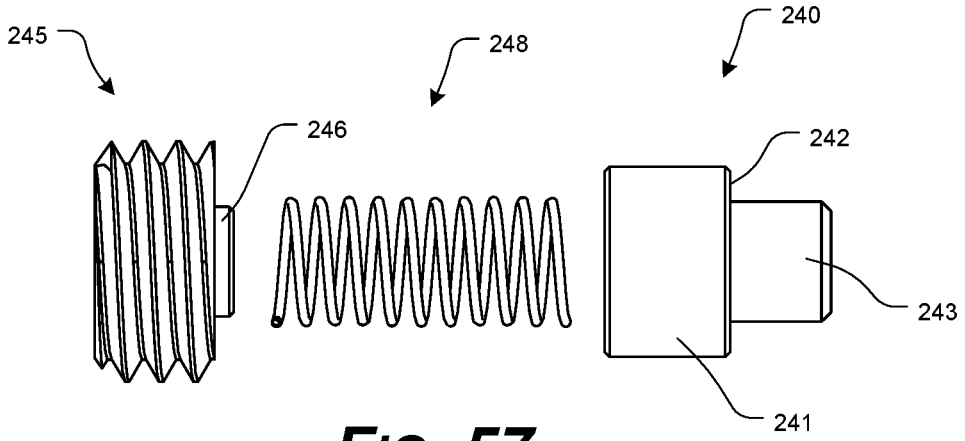
FIG. 57 illustrates an exploded, side view of an exemplary embodiment of various detent components of a modular muzzle device adapter system, according to the present disclosure.
Figure 58:
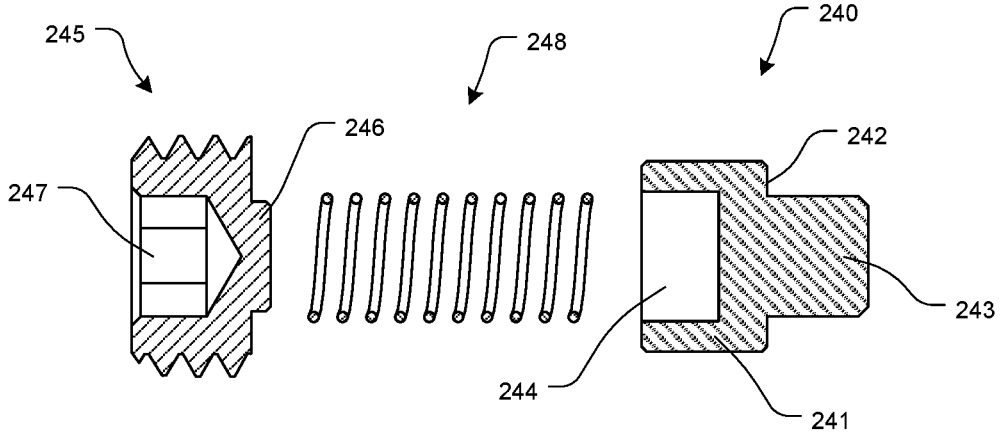
FIG. 58 illustrates an exploded, side, cross-sectional view of an exemplary embodiment of various detent components of a modular muzzle device adapter system, according to the present disclosure.
Figure 59:
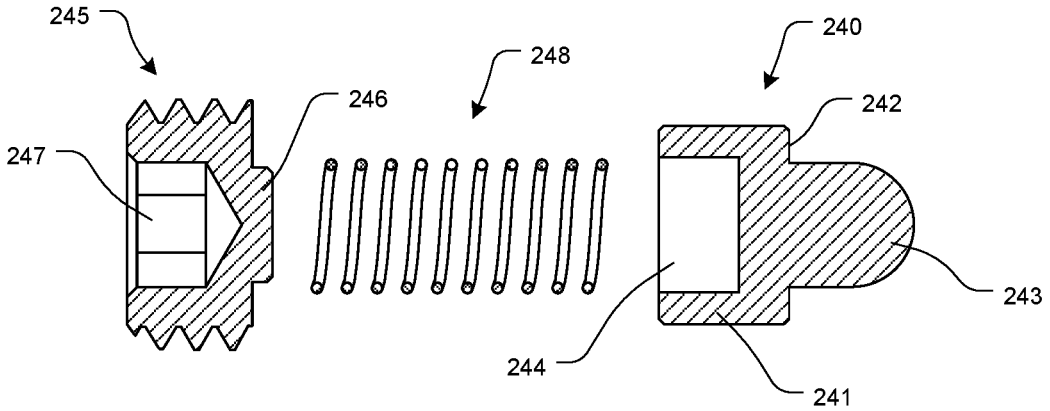
FIG. 59 illustrates an exploded, side, cross-sectional view of an exemplary embodiment of various detent components of a modular muzzle device adapter system, according to the present disclosure.

FIGS. 52-54 illustrate additional exemplary embodiments of an optional muzzle device 250. It should be appreciated that these are merely exemplary and not limiting. Thus, the muzzle device 250 may take any desired shape or form and have any desired number and/or arrangement of optional muzzle device ports 267 (including no muzzle device ports 267).

Figure 60:
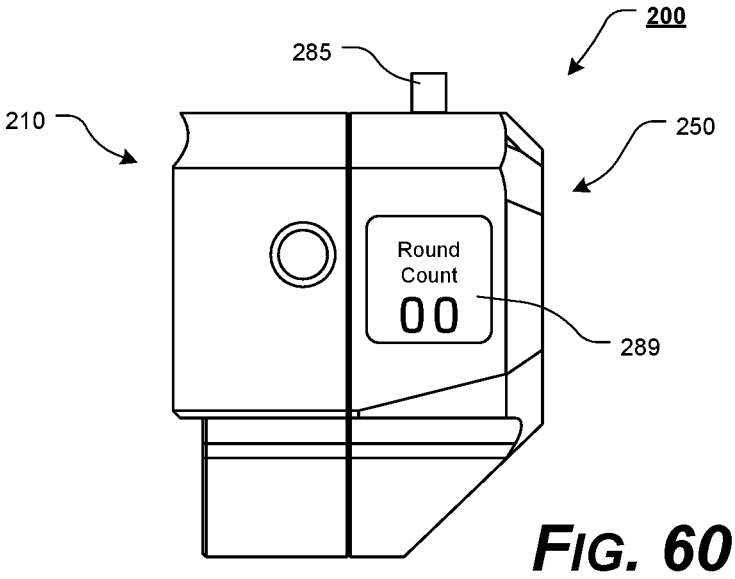
FIG. 60 illustrates a right side view of certain exemplary components of an exemplary embodiment of a modular muzzle device adapter system, according to the present disclosure.
Figure 61:
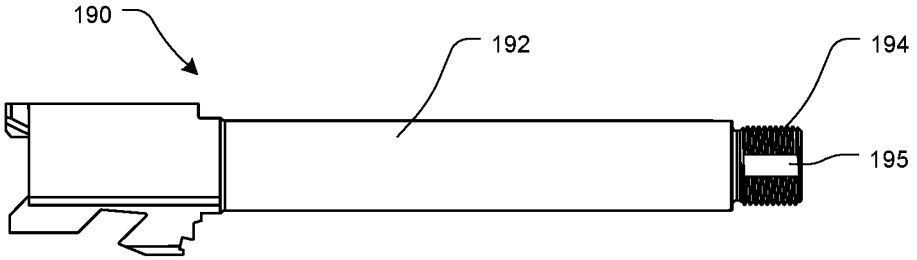
FIG. 61 illustrates a right side view of an exemplary firearm barrel to be utilized in conjunction with various exemplary embodiments of a modular muzzle device adapter system, according to the present disclosure.
Figure 62:
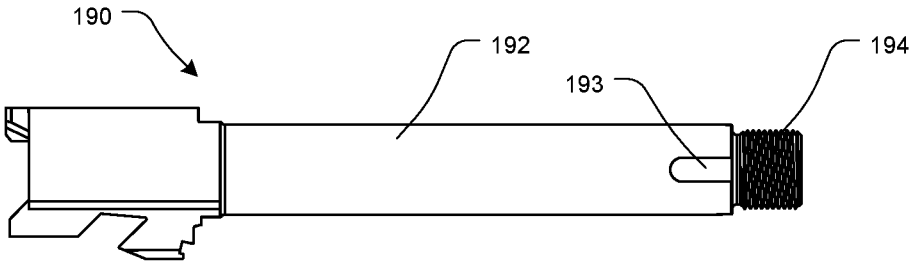
FIG. 62 illustrates a right side view of an exemplary firearm barrel to be utilized in conjunction with various exemplary embodiments of a modular muzzle device adapter system, according to the present disclosure.

As illustrated, for example, in FIG. 60, the exemplary muzzle device 250 may also include an integrated or integral round counter 289, which displays a number of rounds that have passed through the muzzle device 250.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A modular muzzle device adapter system configured to be attached or coupled to a firearm barrel, comprising:

an adapter, further comprising an attachment means for coupling said adapter to said firearm barrel, a bore configured to allow a projectile to pass through, and a locking pin fitted into a recess with a spring below said bore; and a muzzle device configured to removably attach to said adapter, wherein said muzzle device further comprises at least one muzzle device port located on a top portion of said muzzle device, and a hole for said locking pin to fit within.

2. The modular muzzle device adapter system of claim 1, further comprising at least one muzzle device port on each side of said compensation module.

3. A modular muzzle device adapter system, comprising:

an adapter, wherein said adapter comprises an adapter body portion and an adapter projection portion, wherein an adapter projection is formed as a portion of said adapter projection portion of said adapter, wherein said adapter projection is a dovetail projection, and wherein said adapter includes an adapter barrel aperture formed so as to extend through said adapter; and a muzzle device, and wherein said muzzle device comprises a muzzle device body portion and a muzzle device recess, wherein said muzzle device recess is a dovetail muzzle device recess, and wherein said muzzle device is repeatably securable to and removable from said adapter, via at least some slidable interaction between at least a portion of said adapter projection and at least a portion of said muzzle device recess.

4. The modular muzzle device adapter system of claim 3, wherein said adapter projection is a 3-sided dovetail projection and said muzzle device recess is a 3-sided dovetail muzzle device recess, and wherein said muzzle device is attachable to said adapter via slidable interaction between at least a portion of said adapter projection and at least a portion of said muzzle device recess.

5. The modular muzzle device adapter system of claim 3, wherein said adapter barrel aperture extends through said adapter, from a proximal end of said adapter to a distal end of said adapter, substantially parallel to a longitudinal axis, AL, of said adapter.

6. The modular muzzle device adapter system of claim 3, wherein a barrel aperture threaded portion is formed in at least a portion of said adapter barrel aperture, wherein said barrel aperture threaded portion is formed so as to interact with a threaded portion of a firearm barrel such that said adapter may optionally be threadably secured to a firearm barrel, via interaction of said external muzzle threads of said firearm barrel and said internal threads of said barrel aperture threaded portion.

7. The modular muzzle device adapter system of claim 3, wherein one or more fastening element apertures are formed through at least a portion of said adapter body portion, wherein each fastening element aperture is formed so as to allow a fastening element to extend through said adapter body portion and into said adapter barrel aperture, such that said adapter may optionally be secured to a firearm barrel, via frictional engagement between said firearm barrel and at least a portion of said one or more fasteners extending into said adapter barrel aperture.

8. The modular muzzle device adapter system of claim 7, wherein said one or more fastening element apertures are formed proximate a non-threaded portion of said adapter barrel aperture.

9. The modular muzzle device adapter system of claim 7, wherein said one or more fastening element apertures are formed through at least a portion of said adapter body portion, within said barrel aperture threaded portion.

10. The modular muzzle device adapter system of claim 3, further comprising a detent slidably positioned within an adapter detent aperture of said adapter, wherein said adapter detent aperture is formed at a distance spaced apart from said adapter barrel aperture, wherein said detent is repeatably slidable between an engaged position and a disengaged position, wherein at least a portion of said detent extends from said adapter in said engaged position, and wherein said detent is retracted within said adapter is said disengaged position.

11. The modular muzzle device adapter system of claim 10, wherein said detent is spring biased to said engaged position.

12. The modular muzzle device adapter system of claim 10, further comprising a muzzle device detent aperture formed at a distance spaced apart from said muzzle device aperture, wherein said muzzle device detent aperture is formed so as to receive at least a portion of said detent at least partially therein when said muzzle device detent aperture is aligned with said adapter detent aperture and the said detent is in said engaged position.

13. The modular muzzle device adapter system of claim 3, wherein said muzzle device muzzle device includes a muzzle device aperture formed such that when said muzzle device is appropriately attached or coupled to said adapter, said muzzle device aperture is aligned with said adapter barrel aperture.

14. The modular muzzle device adapter system of claim 3, wherein said muzzle device includes one or more muzzle device ports formed through a portion of said muzzle device body portion, extending from a portion of said muzzle device aperture to an outer surface of said muzzle device body portion.

15. The modular muzzle device adapter system of claim 3, wherein said adapter or said muzzle device includes front sight.

16. The modular muzzle device adapter system of claim 3, wherein said adapter or said muzzle device includes a dovetail or other sight recess formed in a portion thereof to allow a front sight to be installed on said adapter or said muzzle device.

17. A modular muzzle device adapter system, comprising:

an adapter, wherein said adapter comprises an adapter body portion and an adapter projection portion, wherein said adapter includes an adapter barrel aperture formed so as to extend through said adapter, wherein an adapter projection is formed as a portion of said adapter projection portion of said adapter, wherein said adapter projection comprises one or more projection locking extensions, and wherein one or more fastening element apertures are formed through at least a portion of said adapter body portion, wherein each fastening element aperture is formed so as to allow a fastening element to extend through said adapter body portion and into said adapter barrel aperture, such that said adapter may optionally be secured to a firearm barrel, via frictional engagement between said firearm barrel and at least a portion of said one or more fasteners extending into said adapter barrel aperture; and a muzzle device, wherein said muzzle device comprises a muzzle device body portion and a muzzle device recess, wherein said muzzle device recess comprises a muzzle device aperture opening having one or more keyhole slots, wherein each keyhole slot corresponds to one of said projection locking extensions, wherein said muzzle device is repeatably securable to and removable from said adapter, via at least some partial rotatable interaction between at least a portion of said adapter projection of said adapter projection and at least a portion of said muzzle device recess, and wherein said muzzle device muzzle device includes a muzzle device aperture formed such that when said muzzle device is appropriately attached or coupled to said adapter, said muzzle device aperture is aligned with said adapter barrel aperture.

* * * * *